US008425350B2

(12) United States Patent
Savarese et al.

(10) Patent No.: US 8,425,350 B2
(45) Date of Patent: Apr. 23, 2013

(54) APPARATUSES, METHODS AND SYSTEMS RELATING TO FINDABLE GOLF BALLS

(75) Inventors: Chris Savarese, Danville, CA (US); Lauro C. Cadorniga, Piedmont, SC (US); Forrest F. Fulton, Los Altos Hills, CA (US); Noel H. C. Marshall, Gerringong (AU); John Glissman, Valley Ford, CA (US); Kenneth P. Gilliland, Petaluma, CA (US); Marvin L. Vickers, Quincy, CA (US); Gerald Latus, Los Gatos, CA (US)

(73) Assignee: RF Corporation, San Carlos, CA (US)

( * ) Notice: Subject to any disclaimer, the term of this patent is extended or adjusted under 35 U.S.C. 154(b) by 39 days.

(21) Appl. No.: 13/230,779

(22) Filed: Sep. 12, 2011

(65) Prior Publication Data

US 2011/0316192 A1 Dec. 29, 2011

Related U.S. Application Data

(63) Continuation of application No. 11/825,890, filed on Jul. 9, 2007, now abandoned, which is a continuation of application No. 10/346,919, filed on Jan. 17, 2003, now abandoned.

(51) Int. Cl.

| | |
|---|---|
| ***A63B 43/00*** | (2006.01) |
| ***A63B 37/00*** | (2006.01) |
| ***A63B 37/02*** | (2006.01) |
| ***A63B 37/04*** | (2006.01) |
| ***B29C 65/02*** | (2006.01) |
| *A63B 67/02* | (2006.01) |
| *A63B 57/00* | (2006.01) |

(52) U.S. Cl.

USPC ..... 473/353; 473/351; 473/151; 473/152; 473/153; 473/154; 473/155; 473/156; 473/377; 473/406; 473/372; 473/409; 473/198; 473/199; 473/200; 473/367; 156/145; 156/146

(58) Field of Classification Search ..... 473/351, 473/353, 151–156, 372, 377, 409, 406, 198–200, 473/367; 156/145–146

See application file for complete search history.

(56) References Cited

U.S. PATENT DOCUMENTS

| | | | |
|---|---|---|---|
| 1,620,290 | A | 3/1927 | Rubin |
| 3,782,730 | A | 1/1974 | Horchler |

(Continued)

FOREIGN PATENT DOCUMENTS

| | | | |
|---|---|---|---|
| DE | 87 09 503.3 | U1 | 1/1988 |
| DE | 39 26 684 | A1 | 2/1991 |

(Continued)

OTHER PUBLICATIONS

Invitation to Pay Additional Fees for PCT International Appln No. US04/001126, mailed Aug. 2, 2004 (5 pages).

(Continued)

*Primary Examiner* — William H McCulloch, Jr.

(74) *Attorney, Agent, or Firm* — Blakely, Sokoloff, Taylor & Zafman LLP

(57) ABSTRACT

Golf balls and a system for finding golf balls and methods for making golf balls and methods for using such balls. In the case of one exemplary golf ball, the ball includes a shell and a core material which is encased in the shell and a tag which is disposed within the core material and which has at least one perforation. The tag includes a diode and an antenna which are coupled together. Another exemplary golf ball includes a shell and a core material which is encased within the shell and a tag which is within the core material and which includes an electrical element which is coupled to an antenna; the tag is detectable over a range of at least 20 feet from a handheld device, and the golf ball has high durability and substantially complies with the golf ball specifications of the United States Golf Association.

12 Claims, 29 Drawing Sheets

U.S. PATENT DOCUMENTS

| | | | | |
|---|---|---|---|---|
| 4,331,957 | A | 5/1982 | Enander et al. | |
| 4,528,566 | A | 7/1985 | Tyler | |
| 4,595,200 | A | 6/1986 | Shishido | |
| 4,660,039 | A * | 4/1987 | Barricks et al. | 342/27 |
| 4,698,781 | A | 10/1987 | Cockerell, Jr. | |
| 4,742,357 | A | 5/1988 | Rackley | |
| 4,955,613 | A | 9/1990 | Gendreau et al. | |
| 5,112,055 | A | 5/1992 | Barnhill | |
| 5,132,622 | A | 7/1992 | Valentino | |
| 5,298,904 | A | 3/1994 | Olich | |
| 5,423,549 | A | 6/1995 | Englmeier | |
| 5,447,314 | A | 9/1995 | Yamazaki et al. | |
| 5,469,175 | A * | 11/1995 | Boman | 342/357.52 |
| 5,480,155 | A * | 1/1996 | Molitor et al. | 473/354 |
| 5,487,542 | A | 1/1996 | Foley | |
| 5,508,350 | A | 4/1996 | Cadorniga et al. | |
| 5,538,794 | A | 7/1996 | Cadorniga et al. | |
| 5,564,698 | A | 10/1996 | Honey et al. | |
| 5,582,550 | A | 12/1996 | Foley | |
| 5,586,950 | A | 12/1996 | Endo | |
| 5,626,531 | A | 5/1997 | Little | |
| 5,662,534 | A | 9/1997 | Kroll et al. | |
| 5,743,815 | A | 4/1998 | Helderman | |
| 5,820,484 | A | 10/1998 | Terry | |
| 5,910,057 | A | 6/1999 | Quimby et al. | |
| 6,107,920 | A | 8/2000 | Eberhardt et al. | |
| 6,113,504 | A | 9/2000 | Kuesters | |
| 6,246,327 | B1 | 6/2001 | Eberhardt | |
| 6,276,266 | B1 | 8/2001 | Dietz et al. | |
| 6,278,402 | B1 * | 8/2001 | Pippin | 342/357.4 |
| 6,284,840 | B1 | 9/2001 | Rajagopalan et al. | |
| 6,336,871 | B1 * | 1/2002 | Ihara et al. | 473/367 |
| 6,357,664 | B1 | 3/2002 | Zercher | |
| 6,390,935 | B1 | 5/2002 | Sugimoto | |
| 6,496,141 | B2 * | 12/2002 | Pippin | 342/357.34 |
| 6,524,199 | B2 * | 2/2003 | Goldman | 473/353 |
| 6,595,872 | B2 * | 7/2003 | Yagley et al. | 473/371 |
| 6,612,940 | B1 * | 9/2003 | Nesbitt et al. | 473/376 |
| 6,620,057 | B1 | 9/2003 | Pirritano et al. | |
| 6,623,380 | B2 * | 9/2003 | Jordan | 473/372 |
| 6,634,959 | B2 | 10/2003 | Kuesters | |
| 6,663,508 | B1 * | 12/2003 | Keller et al. | 473/374 |
| 6,705,942 | B1 | 3/2004 | Crook et al. | |
| 6,762,244 | B2 | 7/2004 | Rajagopalan et al. | |
| 6,840,167 | B2 | 1/2005 | Clark et al. | |
| 7,059,974 | B1 | 6/2006 | Golliffe et al. | |
| 7,095,312 | B2 * | 8/2006 | Erario et al. | 340/323 R |
| 7,207,902 | B1 * | 4/2007 | Hamlin | 473/353 |
| 7,292,138 | B2 * | 11/2007 | Jang | 340/442 |
| 7,691,009 | B2 * | 4/2010 | Savarese et al. | 473/353 |
| 7,766,766 | B2 * | 8/2010 | Savarese et al. | 473/351 |
| 7,791,982 | B2 * | 9/2010 | Karr | 367/140 |
| 7,811,163 | B2 * | 10/2010 | Ratcliffe | 463/3 |
| 8,002,645 | B2 * | 8/2011 | Savarese et al. | 473/353 |
| 2001/0006489 | A1 | 7/2001 | Gaffney | |
| 2001/0045904 | A1 | 11/2001 | Silzer, Jr. | |
| 2002/0004723 | A1 | 1/2002 | Meifu et al. | |
| 2002/0016674 | A1 * | 2/2002 | Rudow et al. | 701/215 |
| 2002/0027524 | A1 * | 3/2002 | Pippin | 342/357.08 |
| 2002/0082120 | A1 | 6/2002 | McLaughlin | |
| 2002/0091017 | A1 | 7/2002 | Kuesters | |
| 2002/0098913 | A1 | 7/2002 | Goldman | |
| 2002/0177490 | A1 | 11/2002 | Yong et al. | |
| 2002/0188359 | A1 * | 12/2002 | Morse | 700/91 |
| 2003/0008727 | A1 | 1/2003 | Miller | |
| 2003/0017884 | A1 | 1/2003 | Masters et al. | |
| 2003/0106634 | A1 | 6/2003 | Adkins et al. | |
| 2003/0191547 | A1 | 10/2003 | Morse | |
| 2004/0014536 | A1 | 1/2004 | Kuesters | |
| 2004/0053708 | A1 * | 3/2004 | Hebert | 473/353 |
| 2004/0058749 | A1 | 3/2004 | Pirritano et al. | |
| 2004/0142766 | A1 | 7/2004 | Savarese et al. | |
| 2005/0070375 | A1 | 3/2005 | Savarese et al. | |
| 2005/0070376 | A1 | 3/2005 | Savarese et al. | |
| 2005/0085316 | A1 * | 4/2005 | Barr | 473/353 |
| 2005/0101411 | A1 * | 5/2005 | Stiller et al. | 473/353 |
| 2005/0261083 | A1 * | 11/2005 | Liao | 473/353 |
| 2006/0038665 | A1 * | 2/2006 | Jang | 340/426.33 |
| 2006/0122007 | A1 * | 6/2006 | Savarese et al. | 473/351 |
| 2006/0128503 | A1 * | 6/2006 | Savarese et al. | 473/353 |
| 2007/0155520 | A1 * | 7/2007 | Savarese et al. | 473/131 |
| 2007/0259740 | A1 * | 11/2007 | Savarese et al. | 473/409 |
| 2008/0207357 | A1 * | 8/2008 | Savarese et al. | 473/407 |
| 2009/0017944 | A1 * | 1/2009 | Savarese et al. | 473/407 |
| 2009/0111602 | A1 * | 4/2009 | Savarese et al. | 473/283 |
| 2009/0233735 | A1 * | 9/2009 | Savarese et al. | 473/407 |
| 2009/0314423 | A1 * | 12/2009 | Savarese et al. | 156/276 |
| 2010/0184563 | A1 * | 7/2010 | Molyneux et al. | 482/1 |
| 2010/0184564 | A1 * | 7/2010 | Molyneux et al. | 482/1 |
| 2010/0293777 | A1 * | 11/2010 | Savarese et al. | 29/593 |
| 2010/0308105 | A1 * | 12/2010 | Savarese et al. | 235/375 |
| 2010/0308939 | A1 * | 12/2010 | Kurs | 333/219.2 |
| 2011/0316192 | A1 * | 12/2011 | Savarese et al. | 264/274 |
| 2012/0052967 | A1 * | 3/2012 | Grieshaber et al. | 473/155 |
| 2012/0142443 | A1 * | 6/2012 | Savarese et al. | 473/199 |
| 2012/0255998 | A1 * | 10/2012 | Luciano et al. | 235/439 |
| 2012/0255999 | A1 * | 10/2012 | Luciano et al. | 235/439 |
| 2012/0256731 | A1 * | 10/2012 | Luciano et al. | 340/10.1 |

FOREIGN PATENT DOCUMENTS

| | | | |
|---|---|---|---|
| DE | 100 57 670 | C1 | 3/2002 |
| EP | 1 035 418 | A1 | 9/2000 |
| FR | 2667 510 | A | 4/1992 |
| GB | 2395 438 | | 5/2004 |
| JP | 07-198836 | | 8/1995 |
| JP | 2003085510 | A | 3/2003 |
| JP | 2003158414 | A | 5/2003 |
| WO | WO 01/02060 | | 1/2001 |
| WO | WO 01/02061 | A1 | 1/2001 |
| WO | WO 03/068874 | A1 | 8/2003 |

OTHER PUBLICATIONS

PCT International Preliminary Report on Patentability for PCT International Appln No. US2004/027598, mailed Apr. 6, 2006 (8 pages).

PCT International Preliminary Report on Patentability for PCT International Appln No. US2004/027597, mailed Apr. 6, 2006 (8 pages).

PCT International Preliminary Report on Patentability for PCT International Appln No. US2006/039416, mailed on Apr. 24, 2008 (8 pages).

PCT International Preliminary Report on Patentability for PCT International Appln No. US2004/001126, mailed Aug. 4, 2005 (14 pages).

PCT Search Report and Written Opinion for PCT International Appln No. US2006/039416, mailed on Jan. 29, 2007 (14 pages).

PCT Search Report for PCT International Appl No. US2004/001126, mailed Mar. 31, 2005 (10 pages).

PCT Search Report for PCT International Appln No. US2004/027597, mailed Nov. 19, 2004 (7 pages).

PCT Search Report for PCT International Appln No. US2004/027598, mailed Dec. 7, 2004 (7 pages).

PCT Written Opinion for PCT International Appln No. US2004/001126, mailed Mar. 31, 2005 (11 pages).

PCT Written Opinion for PCT International Appln No. US2004/027597, mailed Nov. 19, 2004 (6 pages).

PCT Written Opinion for PCT International Appln No. US2004/027598, mailed Dec. 7, 2004 (6 pages).

* cited by examiner

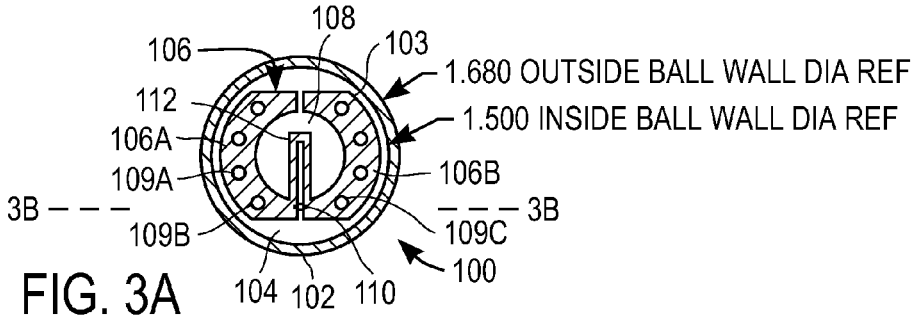
FIG. 3A
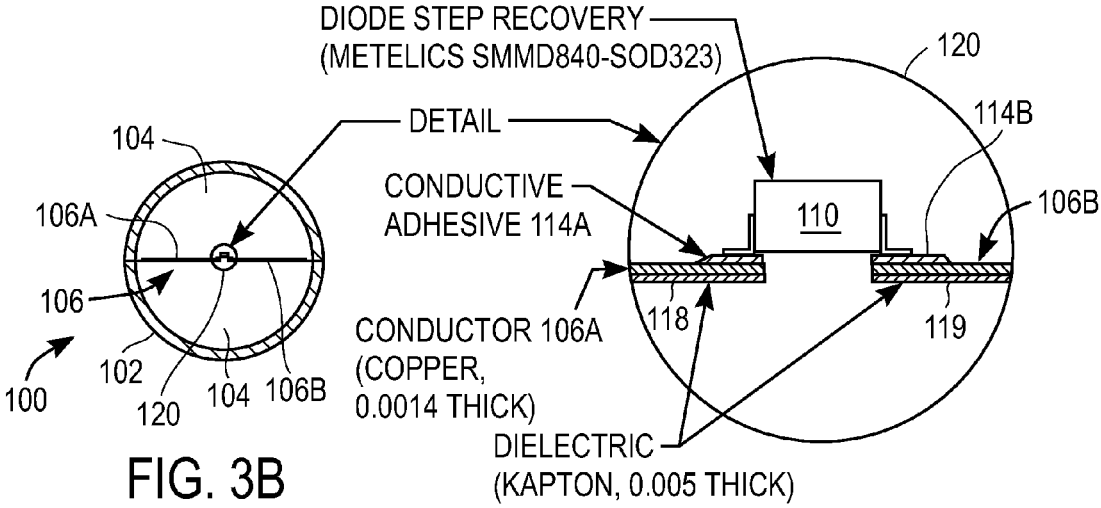
FIG. 3B
FIG. 3C
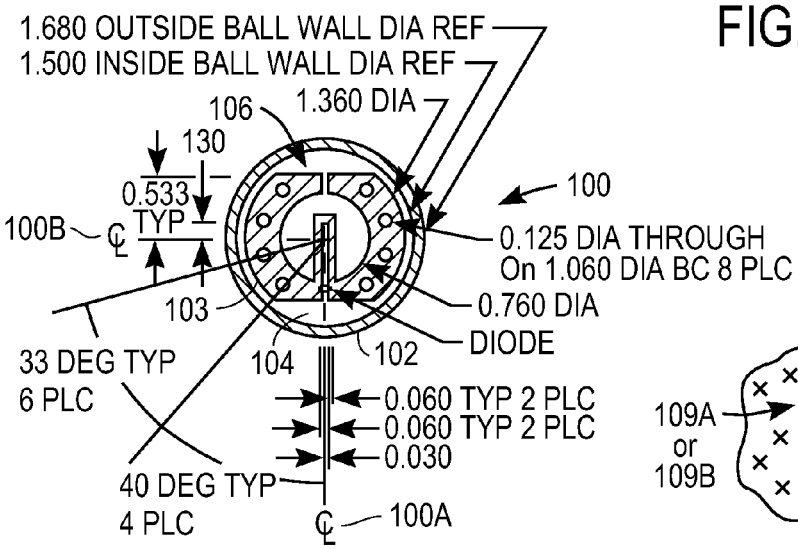
FIG. 3D
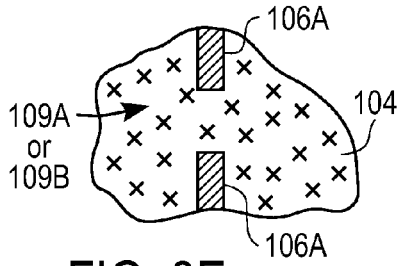
FIG. 3E

APPARATUSES, METHODS AND SYSTEMS RELATING TO FINDABLE GOLF BALLS

RELATED APPLICATIONS

This application is a continuation of U.S. patent application Ser. No. 11/825,890 filed on Jul. 9, 2007, now abandoned which is a continuation of U.S. patent application Ser. No. 10/346,919 filed on Jan. 17, 2003 (now abandoned) and claims priority to said filing date.

FIELD OF THE INVENTION

The inventions relate to sports, such as golf, and more particularly to golf balls, methods for making golf balls and systems for use with golf balls.

BACKGROUND OF THE INVENTION

Golf balls are often lost when people play golf. The loss of the ball slows down the game as players search for a lost ball, and lost balls make the game more expensive to play (because of the cost of new balls). Furthermore, according to the rules of the U.S. Golf Association, a player is penalized for strokes in a round or game of golf if his/her golf ball is lost.

There have been attempts in the past to make findable golf balls in order to avoid some of the problems caused by lost balls. One such attempt is described in German patent number G 87 09 503.3 (Helmut Mayer, 1988). In this German patent, a two piece golf ball is fitted with foil reflectors which are glued to the outer layer of the core. A shell surrounds the foil reflectors and the core. Each of the reflectors consist of a two part foil antenna with a diode connected on the inner ends. The diode causes a reflected signal to be double the frequency of a received signal. A 5 watt transmitter, which is used to beam a signal toward the reflectors, is used to find the ball. The ball is found when a reflected signal is generated by the foil antenna and diode and reflected back toward a receiver. The arrangement of the reflectors and diodes on the ball in this German patent causes the ball to have poor durability and also makes the ball difficult and expensive to manufacture. The impact of a club head hitting such a ball will rapidly cause the ball to rupture due to the interruption of the shell/core interface by the foil reflectors. Furthermore, the presence of the reflectors at this interface will negatively affect the driving distance of such a ball.

Another attempt in the art to make a findable golf ball is described in PCT patent application no. WO 0102060 A1 which describes a golf ball for use in a driving range. This golf ball includes an active Radio Frequency Identification Device (RFID) which identifies a particular ball. The RFID includes an active (e.g., contains transistors) ASIC chip which is energized from the received radio signal. The RFID device is mounted in a sealed capsule which is placed within the core of the ball. The RFID device is designed to be used only at short range (e.g., less than about 10 feet). The use of a sealed capsule to hold the RFID within the ball increases the expense of making this ball.

Other examples of attempts in the prior art to make findable golf balls include: U.S. Pat. Nos. 5,626,531; 5,423,549; 5,662,534; and 5,820,484.

SUMMARY OF THE DESCRIPTION

Apparatuses, methods and systems relating to findable golf balls are described herein.

In one exemplary embodiment of an aspect of the invention, a golf ball includes a shell, a core material which is encased in the shell, and a tag which is disposed in the core material and which has at least one perforation. The tag includes a diode which is coupled to an antenna. In one particular embodiment, the at least one perforation is a void or opening within the outer perimeter of the tag.

In one exemplary embodiment of another aspect of the invention, a golf ball includes a shell and a core material which is encased in the shell and a tag which is disposed within the core material and which is detectable with a handheld transmitting/receiving device over a range of at least about 20 feet (separating the tag and the handheld transmitting/receiving device). The golf ball has high durability (e.g., most such balls can normally survive at least 20 cannon hits using standard testing methodology used by the golf industry) and substantially complies with golf ball specifications of the U.S. Golf Association or the golf ball specifications of the Royal & Ancient Golf Club of St. Andrews.

A system, according to an exemplary embodiment of another aspect of the invention, includes a golf ball, having a tag which includes an antenna and a diode, and a handheld transmitting/receiving device which is capable of detecting the tag over a range of at least 20 feet and which complies with regulations of the Federal Communications Commission.

A method of making a golf ball, according to an exemplary embodiment of another aspect of the invention, includes forming a core precursor member having a first portion and a second portion; placing a tag between the first portion and the second portion, the tag having at least one perforation; placing the first and second portions, with the tag between the portions, into a mold structure; molding the portions, containing the tag, wherein the molding causes material from one of the first and second portions to extrude into the at least one perforation to contact the other of the first and second portions. A core member, formed either directly from the molding process or through processes after the molding, is then encased in a shell. The first and second portions may be created separately through a molding process which creates each portion individually, or they may be created through a molding process which creates a slug which is then sliced substantially in half to form both portions.

Also described herein are several embodiments of handheld transmitter/receivers which may be used to find golf balls containing at least one tag. These handheld transmitter/receivers are, in certain embodiments, designed to find golf balls at a range of at lease about 20 feet and are designed to substantially comply with governmental regulations regarding radio equipment such as Federal Communications Commission (FCC) regulations. For example, these certain embodiments are designed to transmit less than, or equal to, about 1 watt maximum peak power or about 4 watts effective isotropic radiated power.

Also described herein are several alternative embodiments of a tag which includes two diodes which are coupled in parallel between two antenna portions. This tag, in one embodiment, is placed within the core material of a golf ball. This double diode tag may be used as an alternative to the various tags shown herein by substituting the double diode arrangement for the single diode shown in the various tags herein.

Also described herein are several embodiments of tags which have antenna portions in more than one plane. These tags may be considered to be three-dimensional tags, such as several different disclosed embodiments of spiral tags or tags which are initially a planar structure but are then bent or formed into a non-planar structure.

Also described herein are several embodiments of methods for operating a golf course, such as an 18-hole golf course. These methods include giving discounts to golfers who would play with their findable balls and handheld units. Other such methods include searching for lost, findable balls after a golf course has been closed, and cutting the grass in the rough areas less often (such that this grass grows higher than on golf courses which do not use findable balls).

Other embodiments of golf balls, handheld transmitter/receivers, ball and handheld systems, and methods of manufacturing balls and methods of using the balls are described. Other features and embodiments of various aspects of the invention will be apparent from this description.

BRIEF DESCRIPTION OF THE DRAWINGS

The present invention is illustrated by way of example and not limitation in the figures of the accompanying drawings in which like references indicate similar elements.

FIG. 3A is a cross-sectional view of a golf ball which is one embodiment of the present invention.

FIG. 3B is a cross-sectional view of the same golf ball shown in FIG. 3A, except at a different cross-sectional slice of the golf ball.

FIG. 3C shows a magnified view of a portion of the golf ball shown in FIG. 3B.

FIG. 3D shows another cross-sectional view of the golf ball of FIG. 3A; this view shows various dimensions for one particular embodiment.

FIG. 3E shows a cross-sectional view, taken in a plane which is perpendicular to the plane of the tag shown in FIG. 3A.

DETAILED DESCRIPTION

Various embodiments and aspects of the invention will be described with reference to details set below, and the accompanying drawings will illustrate the invention. The following description and drawings are illustrative of the invention and are not to be construed as limiting the invention. Numerous specific details such as sizes and weights and frequencies are described to provide a thorough understanding of various embodiments of the present invention. However, in certain instances, well-known or conventional details are not described in order to not unnecessarily obscure the present invention in detail.

Figure 1A:
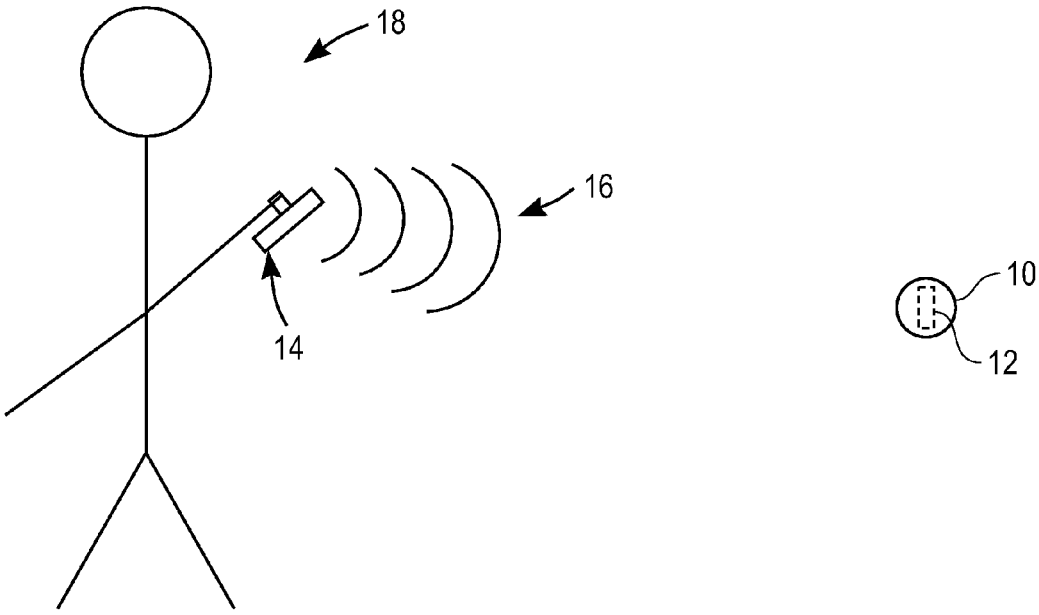
FIG. 1A shows a system for finding a golf ball according to one embodiment of the present invention.

FIG. 1A shows an example of the system which uses a handheld transmitter/receiver to find a findable golf ball. A person 18 such as a golfer, may carry a handheld transmitter/receiver which is designed to locate a findable golf ball 10 which includes a tag 12 embedded in the golf ball. The handheld transmitter/receiver 14 may operate as a radar system which emits an electromagnetic signal 16 which then can be reflected by the tag 12 back to the transmitter/receiver which can then receive the reflected signal in a receiver in the handheld unit 14. Various different types of tags, such as tag 12, are described further below for use in the golf ball 10. These tags typically include an antenna and a diode coupled to the antenna. The diode serves to double the frequency of the reflective signal (or to provide another harmonic of the received signal), which makes it easier for the receiver to detect and find a golf ball as opposed to another object which has reflected the emitted signal without modifying the frequency of the emitted signal. The tag within the golf ball 10 is typically positioned near the center of the ball and it is positioned such that the symmetry of the ball is maintained. For example, the center of gravity (and symmetry) of a ball with a tag is substantially the same as a ball without a tag. The tag in certain embodiments is of such a weight and size so that the resulting ball containing the tag has the same weight and size as a ball which complies with the United States Golf Association specifications or the specifications of the Royal & Ancient Golf Club of St. Andrews ("R&A"). Furthermore, in certain embodiments, a ball with a tag has the same performance characteristics (e.g. initial velocity) as balls which were approved for use by the United States Golf Association or the R&A. In certain embodiments, the tag may include a perforation or void or hole, often within the outer perimeter of the tag's antenna. This perforation or void or hole increases the durability of the ball, typically by allowing the two portions to mate through the perforation and/or by allowing the core rubber composition to flow through the perforation to give greater strength within the ball. Thus, the durability of the ball is significantly improved.

Figure 1B:
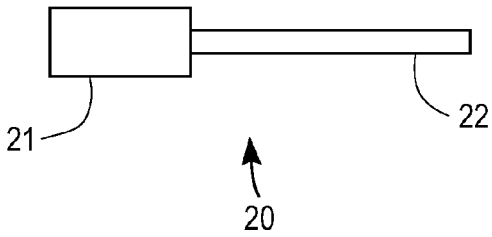
FIG. 1B is a side view of an exemplary embodiment of a handheld transmitter/receiver which may be used with embodiments of the present invention.
Figure 1C:
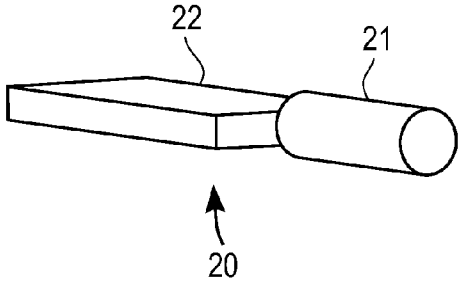
FIG. 1C is a perspective view of a handheld transmitter/receiver of FIG. 1B.

The handheld unit 14 shown in FIG. 1A may have the form shown in FIGS. 1B and 1C. This form, shown in FIGS. 1B and 1C, is one example of many possible forms for a handheld unit. This handheld device is typically a small device having a cylindrical handle which may be 4-5 inches long, and may have a diameter of approximately 1.5 inches. The cylindrical handle, such as handle 21, is attached to a six-sided solid which includes an antenna, such as the antenna casing 22 shown in FIGS. 1B and 1C. FIG. 1B is a side view of a handheld transmitter/receiver which may be used in certain embodiments of the present invention. FIG. 1C is a perspective view of a handheld unit shown in FIG. 1B. The handheld unit is preferably compliant with all regulations of the Federal Communications Commission and is battery powered. The batteries may be housed in the handle 21, and they may be conventional AA batteries which may be placed into the handle by a user or they may be rechargeable batteries which can be recharged either through the use of an AC wall/house socket or a portable rechargeable unit (e.g. in a golf cart). In order to comply with regulations of the Federal Communications Commission (FCC) or other applicable governmental regulations regarding radio equipment, the handheld may emit pulsed (or non-pulsed) radar with a power that is equal to or less than 1 watt. In certain embodiments, the handheld unit may emit through its transmitter pulsed radar signals up to 1 watt maximum peak power and up to 4 watts effective isotropic radiated power (EIRP). Thus, the handheld unit for locating golf balls may be sold to and used by the general public in the United States. Several embodiments of handheld transmitters/receivers are described further below. At least some of these embodiments may be sold to and used by the general public in countries other than the United States because the embodiments meet regulatory requirements of those countries. For example, a handheld unit for use and sale in the European Union will normally be designed and manufactured to meet the CE marking requirements and the National Spectrum Authority requirements per the R&TTE (Radio and Telecommunications Terminal Equipment) Directive.

Figure 2A:
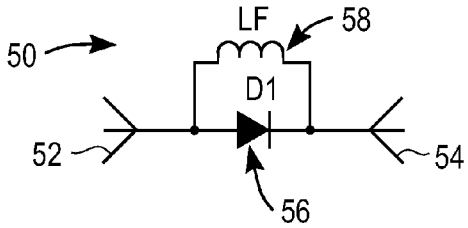
FIG. 2A is an electrical schematic which illustrates an embodiment of a circuit for a tag according to one aspect of the invention.
Figure 2B:
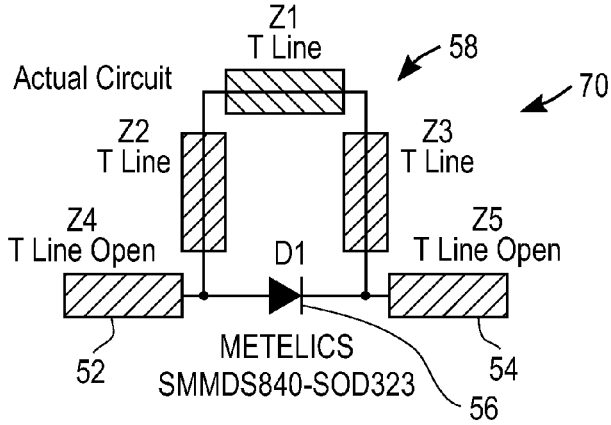
FIG. 2B shows a structural representation of the circuit of FIG. 2A.

FIG. 2A shows an electrical schematic of a tag according to one embodiment. The circuit of the tag 50 includes an antenna having two portions 52 and 54. The portion 52 is coupled to one end of the diode 56, and the portion 54 is coupled to the other end of the diode 56. A transmission line 58 which includes an inductor is coupled in parallel across the diode 56 as shown in FIG. 2A. The diode 56 is designed to double the received frequency so that the reflected signal from the tag is twice (or some harmonic) of the received signal. It will be appreciated that the double harmonic described herein is one particular embodiment, and alternative embodiments may use different harmonics or multiples of the received signal. FIG. 2B shows a structural representation of the circuit of FIG. 2A. In particular, FIG. 2B shows the antenna portions 52 and 54 coupled to their respective ends of the diode 56 which is in turn coupled in parallel to a transmission line 58. In one embodiment of the circuit 70, the diode 56 may be a diode from Metelics Corporation, part number SMND-840, which is available in a package referred to as an SOD323 package. The circuits shown in FIGS. 2A and 2B may be implemented in structures that have various different shapes and configurations as will be apparent from the following description.

Figure 2C:
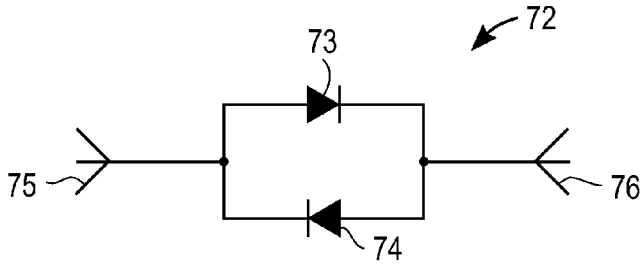
FIGS. 2C and 2D are electrical schematics which show other exemplary embodiments of a circuit for a tag according to one aspect of the invention.
Figure 2D:
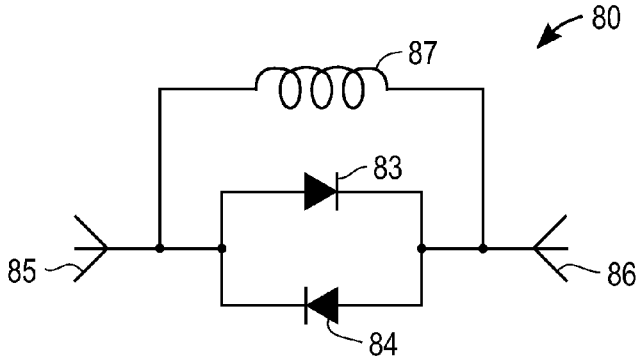

FIGS. 2C and 2D show two exemplary embodiments of a tag which uses two diodes which are coupled in parallel between the two antenna portions. Any of the various tags (e.g. shown in FIG. 3A-5P or 9A-9H or 10A or 10C) shown or described herein may use either of the circuits of FIG. 2C or 2D rather than the single diode implementation of FIG. 2A. In the one case of tag 72, there is no inductor, and in the case of the tag 80, there is an inductor which may be used to match the impedance of the diodes to the impedance of the antennas (antenna portions).

The tag 72 shown in FIG. 2C includes diodes 73 and 74 which are coupled together in parallel between antenna portions 75 and 76. The two diodes are in a parallel connection but with reversed cathode-anode (N-P) orientation. This configuration will produce a stronger second harmonic response from the tag because of the resulting full wave implementation of the frequency doubling process. Thus, the tag (and hence the ball containing the tag) will be findable at a greater range. This double diode may be formed in a single integrated circuit at substantially the same cost as the single diode 56 shown in FIG. 2A. It will be appreciated that in such an integrated circuit, the P portion of the diode 73 is coupled to the N portion of the diode 74, and the P portion of the diode 74 is coupled the N portion of the diode 73.

The tag 80 shown in FIG. 2D is similar to the tag 72 except that an inductor 87 is included in this tag's circuit. The inductor 87 is coupled in parallel with the two diodes 83 and 84, which are coupled in reverse cathode-anode orientation as in the case shown in FIG. 2C. The two diodes and the inductor are coupled in series between the antenna portions 85 and 86 as shown in FIG. 2D. The inductor 87 is an optional feature which may be used to match the impedance of the diodes to the impedance of the antenna portions 85 and 86.

FIG. 3A shows a cross-sectional view taken through the center of a golf ball of one embodiment of the invention. The cross-sectional view is in the plane of the tag which in this embodiment is a planar structure formed primarily by two antenna portions 106A and 106B. An end view of the tag in FIG. 3B clearly shows the substantially planar structure of the tag. The cross-section of FIG. 3B is taken along the line 3B-3B as shown FIG. 3A. FIG. 3C shows a magnified view of a portion of the tag within the bubble 120 shown in FIG. 3D. It will be appreciated that the bubble 120 is not a structural feature of the tag or the ball 100, but rather, is merely shown for purposes of illustration so that the portion being magnified can be easily recognized. FIG. 3D shows the same view of a golf ball 100 as FIG. 3A except that FIG. 3D includes various exemplary dimensions for the tag and ball shown in FIG. 3D.

The golf ball 100 shown in FIG. 3A includes a shell 102 and a core which is formed from core material 104. The shell 102 is sometimes referred to as an outer cover shell. The tag includes an antenna 106, having antenna portions 106A and 106B, and a diode 110, and a transmission line 112. The outer perimeter 103 of the tag substantially conforms with the outer diameter of the core formed from the core material 104. The antenna 106 which includes antenna portions 106A and 106B is electrically coupled to the diode 110 through a conductive adhesive 114A and 114B (shown in FIG. 3C). In one embodiment the conductive adhesive is solder. In an alternative embodiment, the conductive adhesive is a resilient conductive epoxy which includes metallic powder which is conductive and which is mixed with the epoxy. Examples of such resilient conductive adhesives include conductive adhesives from Tecknit and an adhesive such as adhesive 2111 from Bondline Electronic Adhesives, Inc. The use of a compressible, and resilient conductive adhesive will improve the chances of the connection between the diode and the antenna surviving many shocks due to the golf club head hitting the golf ball. The transmission line 110 is coupled between the two antenna portions 106A and 106B as shown in FIG. 3A. Referring back to FIG. 2B, the transmission line 112 corresponds to the transmission line 58 of FIG. 2B, and the antenna portion 106A corresponds to the antenna portion 52, and the antenna portion 106B corresponds to the antenna portion 54, while the diode 56 of FIG. 2B corresponds to the diode 110 of FIG. 3A. The tag in the ball 100 of FIG. 3A includes several perforations or openings which exist from one side of the tag through and to the other side of the tag. These perforations include the void or perforation 108 which is within the central portion of the tag, and the perforations 109A and 109B and 109C which are on the antenna portions 106A and 106B as shown in FIG. 3A. Other perforations, not labeled with numerals are also shown on the antenna portions 106A and 106B. These perforations may be regularly spaced or irregularly spaced on the antenna portions. All the perforations shown in FIG. 3A are within the outer perimeter 103 of the tag. These perforations allow the core material 104 to extrude through the perforations during the manufacturing process such that a unitary core material is formed through the perforations, thereby providing for greater durability of the golf ball. This can be seen from FIG. 3E which shows a cross-sectional view of the ball 100 taken around the region of the perforation 109A, where the cross-sectional view is perpendicular to the plane of the antenna portion 106A. As shown in FIG. 3E, the antenna portion 106A includes perforation 109A. As a result of the molding process described below, the core material 104 is extruded through the perforation 109A forming a unitary structure on both sides of the perforation and through the perforation as shown in FIG. 3E. A similar effect occurs at all of the other perforations, such as the perforation 108 which is centrally located within the outer perimeter 103 of the tag.

FIG. 3D shows various exemplary dimensions for a tag and ball, such as the golf ball 100. The exterior or outside ball diameter is about 1.68 inches. The inside diameter of the shell 102, which coincides with the outside diameter of the core is about 1.5 inches. The approximate diameter of the outer perimeter 103 of the tag is about 1.36 inches. The approximate diameter of the centrally located perforation 108 is approximately 0.76 inches. The approximate diameter of each of the eight perforations on the antenna portions 106A and 106B is approximately 0.125 inches in diameter. These eight perforations in the two antenna portions 106A and 106B are located substantially on a circle which has a diameter of 1.06 inches. The angular separation between these eight perforations is approximately 33°, while the angular separation between the end perforations and the centerline 100A is about 40°. The distance from the centerline 100B, which horizontally intersects the center of the ball 100, to the top of the antenna shown in FIG. 3D, is about 0.533 inches. Thus, the typical top to bottom length of the antenna 106 in the view shown in FIG. 3D is about 1.066 inches. The following dimensions are with respect to the "U" shaped transmission line 112 which is centrally located within the perforation 108 as shown in FIGS. 3A and 3D. This "U" shaped transmission line is formed from the same copper material as the antenna portions 106A and 106B. Typically, the antenna 106 and the transmission line 112 are formed from a unitary piece of copper which is etched to have the shape shown in FIGS. 3A and 3D, and then the diode 110 is attached through a conductive adhesive as shown in FIG. 3C. The width of the transmission line 112 is about 0.06 inches. Including this width, the "U" shaped transmission line 112 extends from the centerline 100B up towards the top of the ball shown in FIG. 3D by approximately 0.136 inches. There is a perforation or void between the inside edges of the "U" shaped transmission line. The size of this void from one side of the inside edge of the "U" shaped transmission line to the other side of the inside edge of the transmission line is approximately 0.06 inches. The gap from the centerline 100A to an inside edge of the "U" shaped transmission line is about 0.03 inches.

It is often desirable to mount an antenna in a tag, such as antenna 106, on an insulating substrate. In the embodiment shown in FIGS. 3A through 3E, the tag is mounted on a dielectric (insulating) substrate, which in this case is a layer of an insulator known as Kapton, which is approximately 0.005 inches thick. The Kapton layers 118 and 119 shown in FIG. 3C leave open the void created by the "U" shaped transmission line. In effect, in the embodiment shown in FIGS. 3A through 3E, where there is no copper (e.g., antenna), there is no Kapton such that the Kapton does not exist in the perforation 108, and does not exist in the perforations in the antenna portions, such as perforations 109A, 109B, and 109C. In this manner, the perforations exist from one side of the tag to the other side of the tag thereby allowing the core material 104 to extrude through the perforations to form a unitary structure of core material from one side of the tag through and to the other side of the tag. It will be appreciated that the Kapton may be allowed to exist in certain places where there is no copper (antenna), such as in the void of the copper of the "U" shaped transmission line. In this case, there is no perforation in the Kapton and no perforation in the tag which allows for the extrusion of core material through the perforation in the molding process.

The ball 100 shown in FIGS. 3A, 3B and 3D may be constructed in a manner such that complies with the specifications for a golf ball of the U.S. Golf Association or the R&A. For example, the weight of the golf ball without the tag will be approximately 45.50 grams but not exceeding 45.927 grams (total ball and tag weight), and the weight of the tag (all components) may be about 0.359 grams, which results from the combination of the weight of the Kapton dielectric, the copper antenna, the diode, and the conductive adhesive, each of which respectively are 0.157 grams, 0.182 grams, 0.004 grams, and 0.0156 grams. The size and shape of the golf ball as shown in FIG. 3A is within the specifications for a golf ball of the U.S.G.A. (United States Golf Association) or the R&A and thus, the weight and size of such a golf ball complies with the specifications of the U.S.G.A. or the R&A. Furthermore, it has been determined that a golf ball with a tag such as that shown in FIG. 3A has sufficiently high durability to comply with the durability characteristics of golf balls normally approved by the U.S.G.A. or the R&A for tournament play. For example, a golf ball of the form shown in FIG. 3A will normally survive many cannon hits, which is the conventional way of testing the durability of golf balls. Most golf balls designed according to the embodiment of FIG. 3A survive at least 20 cannon hits and many such golf balls survive nearly 40 cannon hits, which is considered to be a desired goal for durability of golf balls. Furthermore, it has been found that the flight characteristics (e.g. initial velocity) of a golf ball such as golf ball 100 shown in FIG. 3A, substantially complies with the flight characteristics of golf balls specified by the U.S. Golf Association or the R&A. Thus, the overall distance the ball travels with normal hits, and its initial velocity and other parameters normally specified in the requirements of the U.S.G.A. or the R&A under their standard testing procedure, are satisfied by the golf ball fabricated as described in the embodiment shown in FIG. 3A.

Figure 4A:
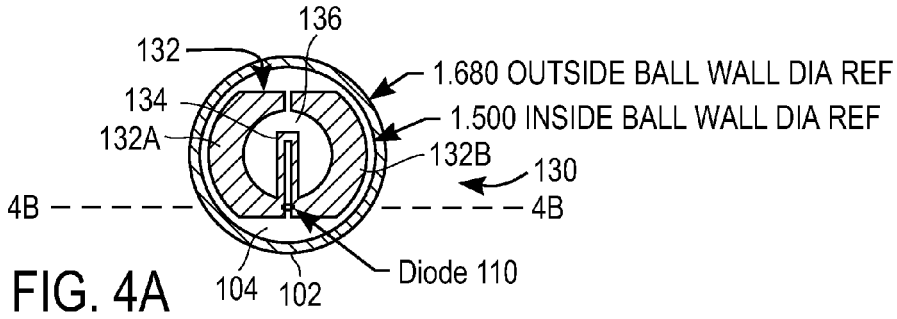
FIG. 4A shows a cross-sectional view of another embodiment of a golf ball with a tag according to the present invention.
Figure 4B:
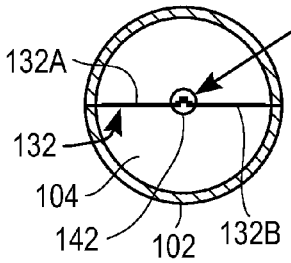
FIG. 4B shows the golf ball of FIG. 4A at a different cross-sectional view.
Figure 4C:
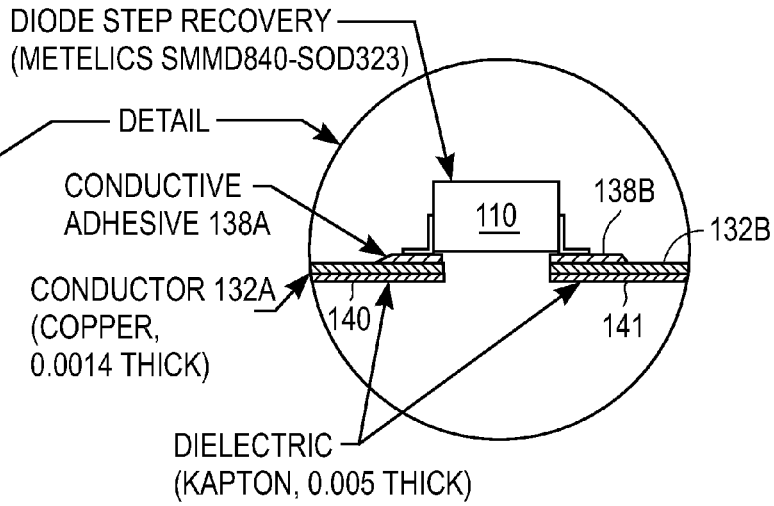
FIG. 4C shows a magnified view of a portion of the golf ball shown in FIG. 4B.
Figure 4D:
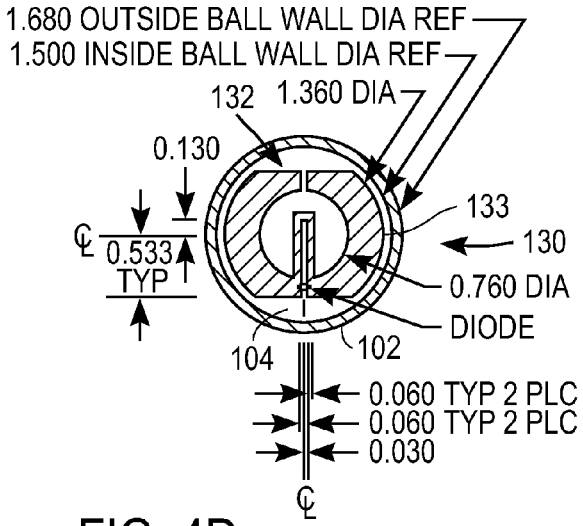
FIG. 4D shows the same cross-sectional view as FIG. 4A with specific measurements for a particular embodiment of a golf ball according to the present invention.

FIGS. 4A, 4B, 4C, and 4D show an alternative embodiment of a golf ball according to the present invention. The golf ball 130 shown in FIGS. 4A, 4B, 4C, and 4D is very similar to the golf ball 100 shown in FIGS. 3A, 3B, 3C, 3D, and 3E. The golf ball 130 has substantially the same specifications as the golf ball 100, as shown by the measurements of FIG. 4D and the measurements of FIG. 3D. Moreover, the tag of the golf ball 30 includes a diode 110 and an antenna 132 which is similarly shaped to the antenna 106 of FIG. 3A. Moreover, a transmission line 134 is similarly shaped to transmission line 112 of FIG. 3A. Furthermore, a shell 102 having an outside diameter of about 1.68 inches surrounds the core material 104 which has an outside diameter (corresponding to the inside diameter of the shell 102) of about 1.5 inches. A tag having an antenna 132 formed by antenna portions 132A and 132B, is coupled to the diode 110 and to the transmission line 134. A perforation 136 is located within the outer perimeter of the antenna 132 and serves a similar purpose as the perforation 108 of FIG. 3A. However, the antenna portions 132A and 132B do not include perforations (unlike the antenna portions 106A and 106B of FIG. 3A which do include perforations, such as perforations 109A and 109B). This can be seen in the view of FIG. 4A which is a cross-sectional view of the plane of the tag; this view shows that there are no perforations in the antenna portions 132A and 132B, unlike the perforations in the antenna portions 106A and 106B of FIG. 3A. The view shown in FIG. 4B is similar to the view shown in FIG. 3B. This view may be considered to be an end view which is parallel with the plane of the tag and which shows how a diametric axis which passes through the center of the golf ball is substantially aligned with a diametric axis of the tag formed primarily by the antenna 132. The bubble 142 is shown for illustrative purposes in FIGS. 4B and 4C, and is understood to be not required to be a part of the physical structure of the golf ball, but is used rather for purposes of illustration. FIG. 4C shows a magnified view of a portion within the bubble 142. This magnified view shows that the diode 110 is coupled by a conductive adhesive 138A and 138B to their respective antenna portions 132A and 132B. The conductive adhesive 138A and 138B may be similar to the conductive adhesive 114A described above. The antenna portions 132A and 132B may be a copper conductor which has a thickness of approximately 0.0014 inches thick. A substrate which is an insulator, such as Kapton, may be applied below the copper antenna. The Kapton does not exist in the perforation area 136, and thus this perforation area allows for the two portions of a core precursor which is placed within a mold to bind through the perforation 136 to perform a unitary structure, such as the structure shown in FIG. 3E, wherein the structure extends through the perforation as shown in FIG. 3E. The perforation 136 is contained within the outer perimeter 133 which substantially conforms with the outer diameter of the core member as shown in FIG. 4D.

Figure 5A:
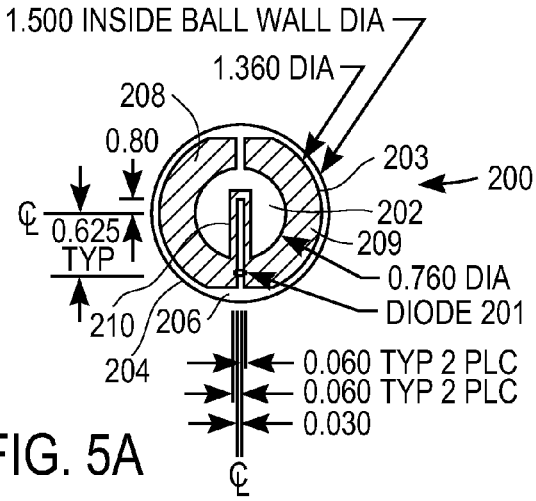
FIG. 5A shows a cross-sectional view of another embodiment of a golf ball of the invention.
Figure 5B:
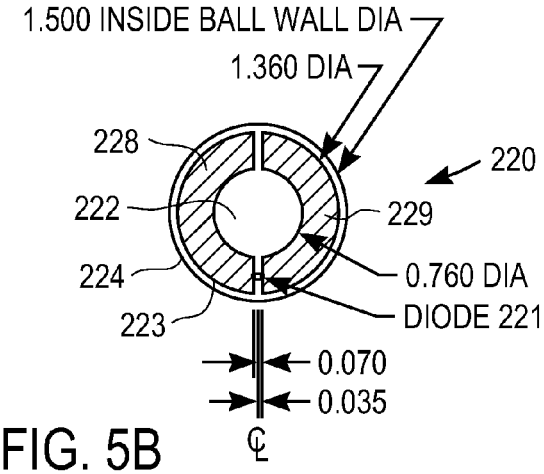
FIG. 5B shows a cross-sectional view of another embodiment of a golf ball of the invention.
Figure 5C:
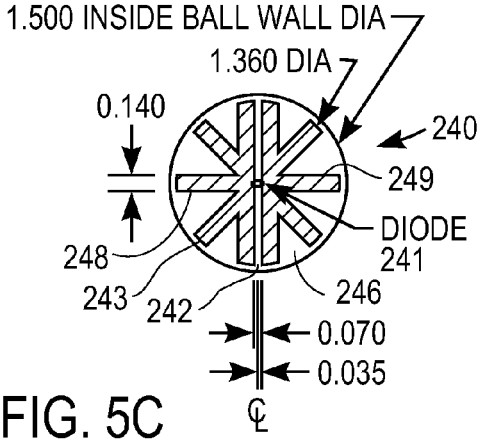
FIG. 5C shows a cross-sectional view of another embodiment of a golf ball of the invention.
Figure 5D:
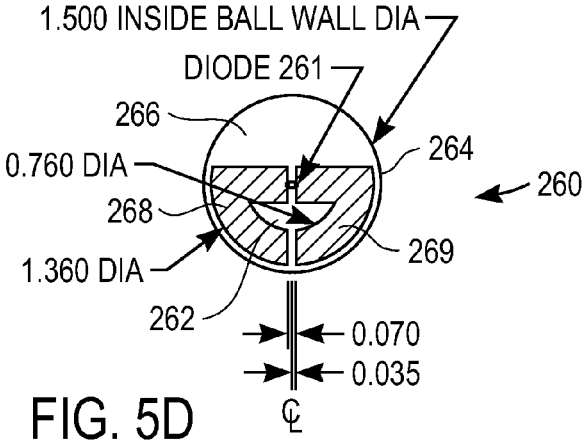
FIG. 5D shows a cross-sectional view of another embodiment of a golf ball of the invention.
Figure 5E:
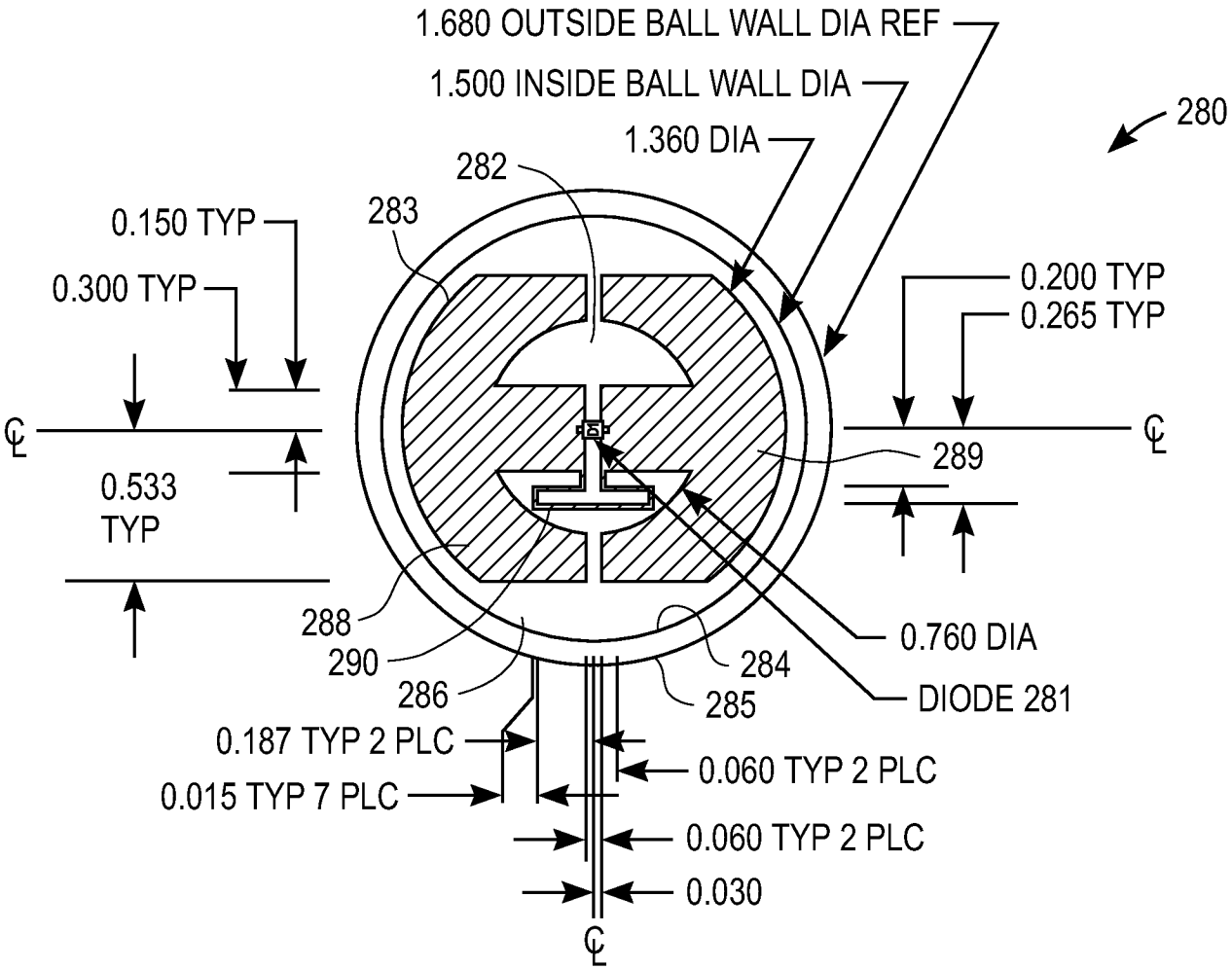
FIG. 5E shows a cross-sectional view of another embodiment of a golf ball of the invention.
Figure 5F:
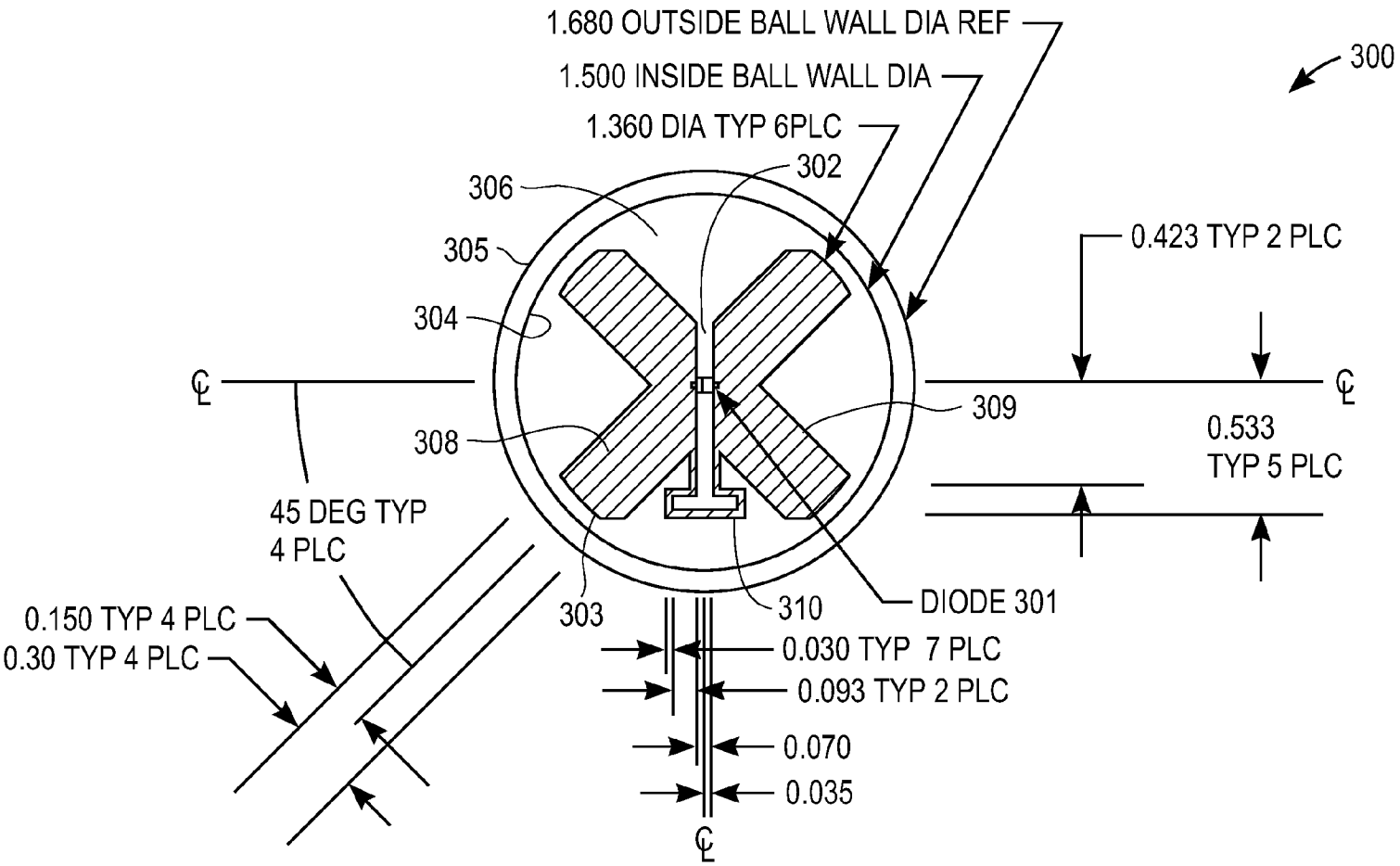
FIG. 5F shows a cross-sectional view of another embodiment of a golf ball of the invention.
Figure 5G:
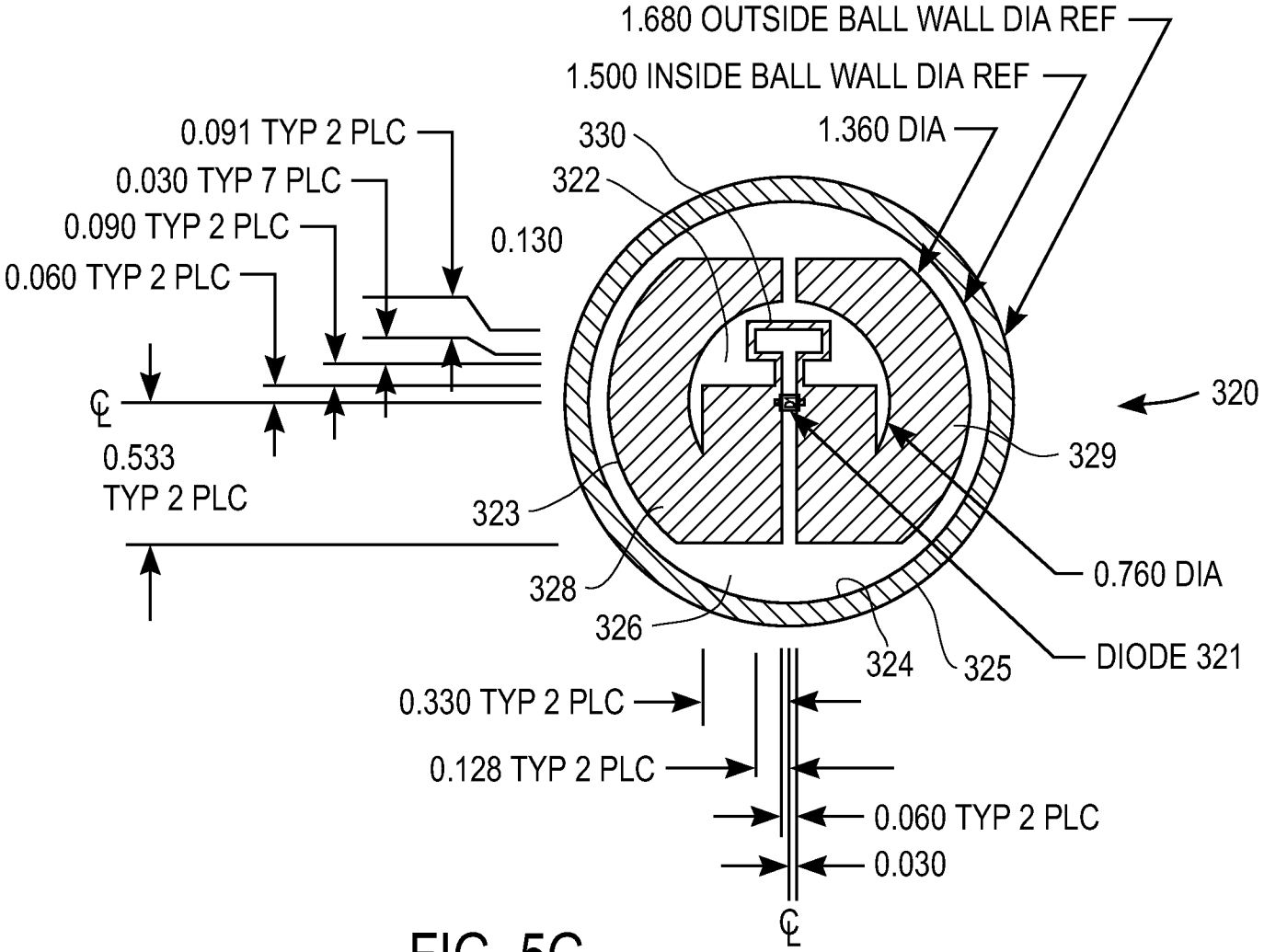
FIG. 5G shows a cross-sectional view of another embodiment of a golf ball of the invention.
Figure 5H:
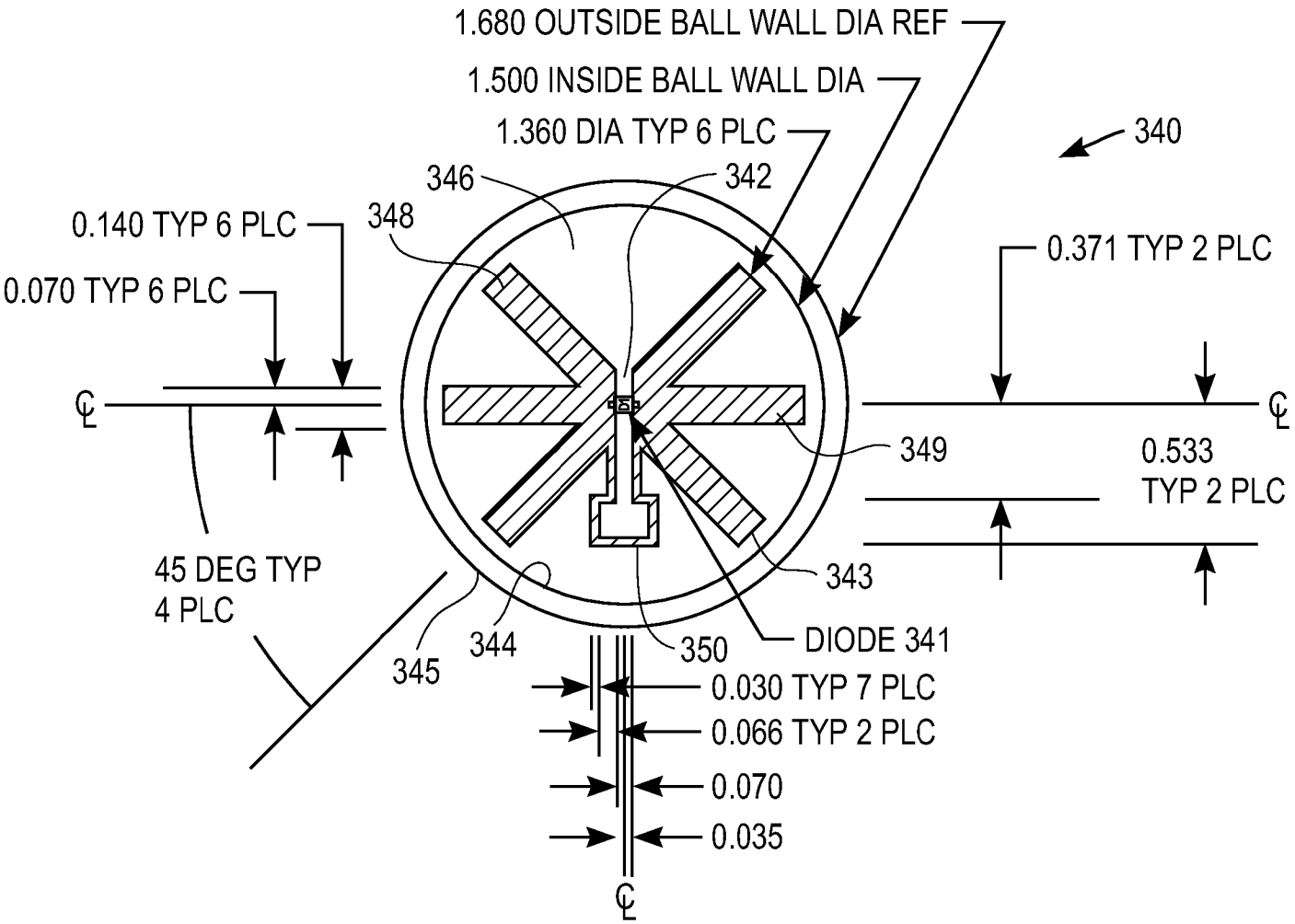
FIG. 5H shows a cross-sectional view of another embodiment of a golf ball of the invention.
Figure 5I:
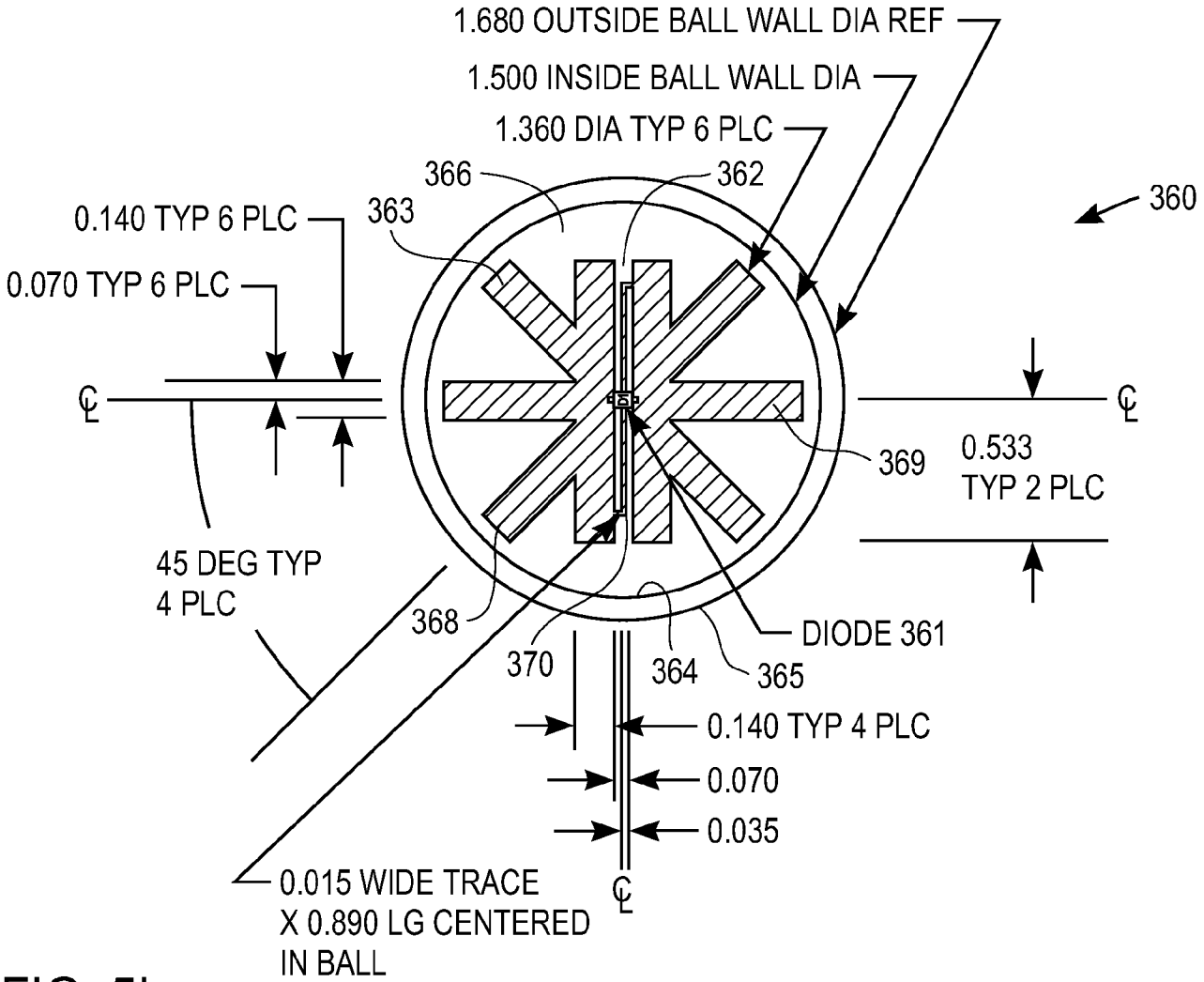
FIG. 5I shows a cross-sectional view of another embodiment of a golf ball of the invention.
Figure 5J:
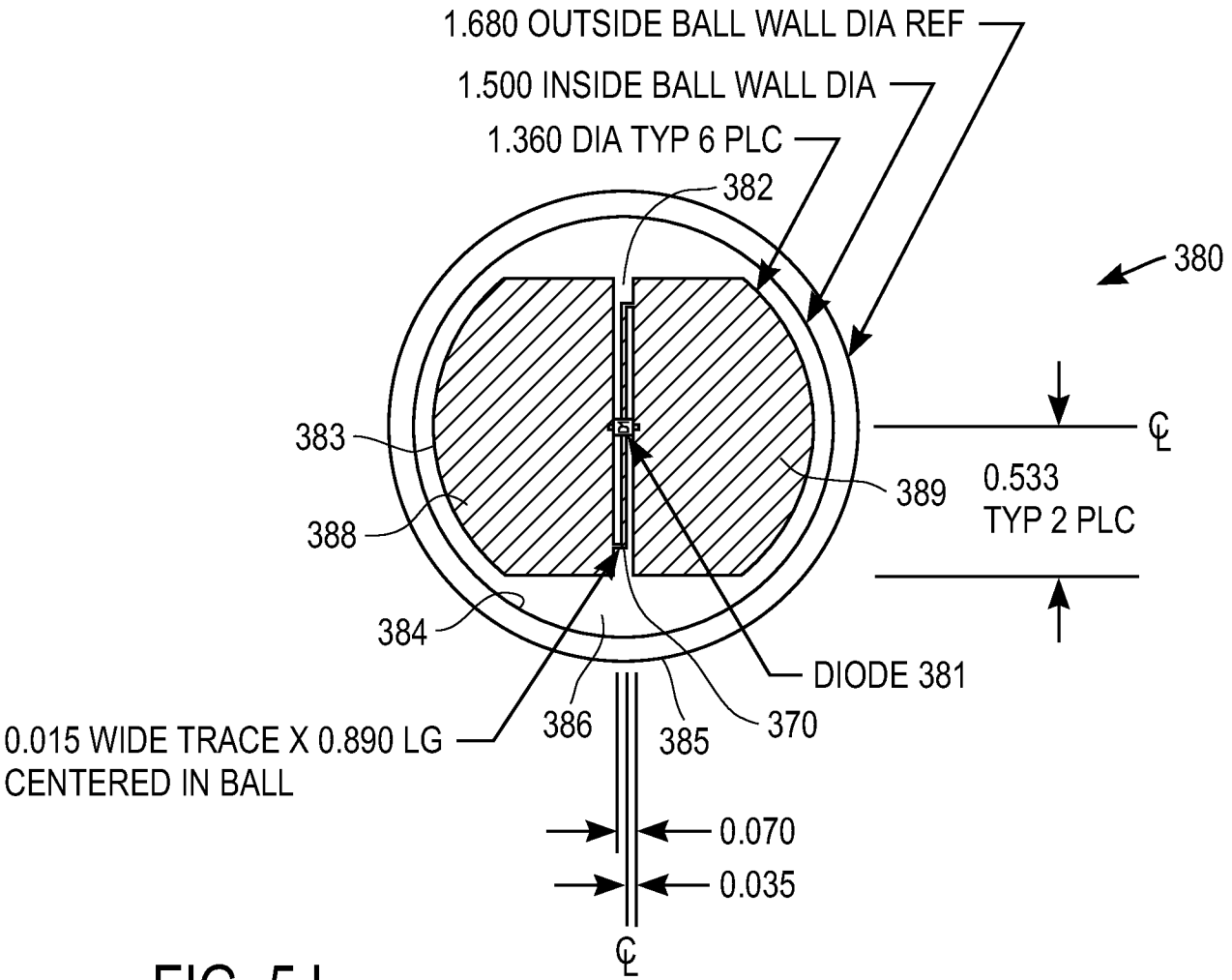
FIG. 5J shows a cross-sectional view of another embodiment of a golf ball of the invention.
Figure 5K:
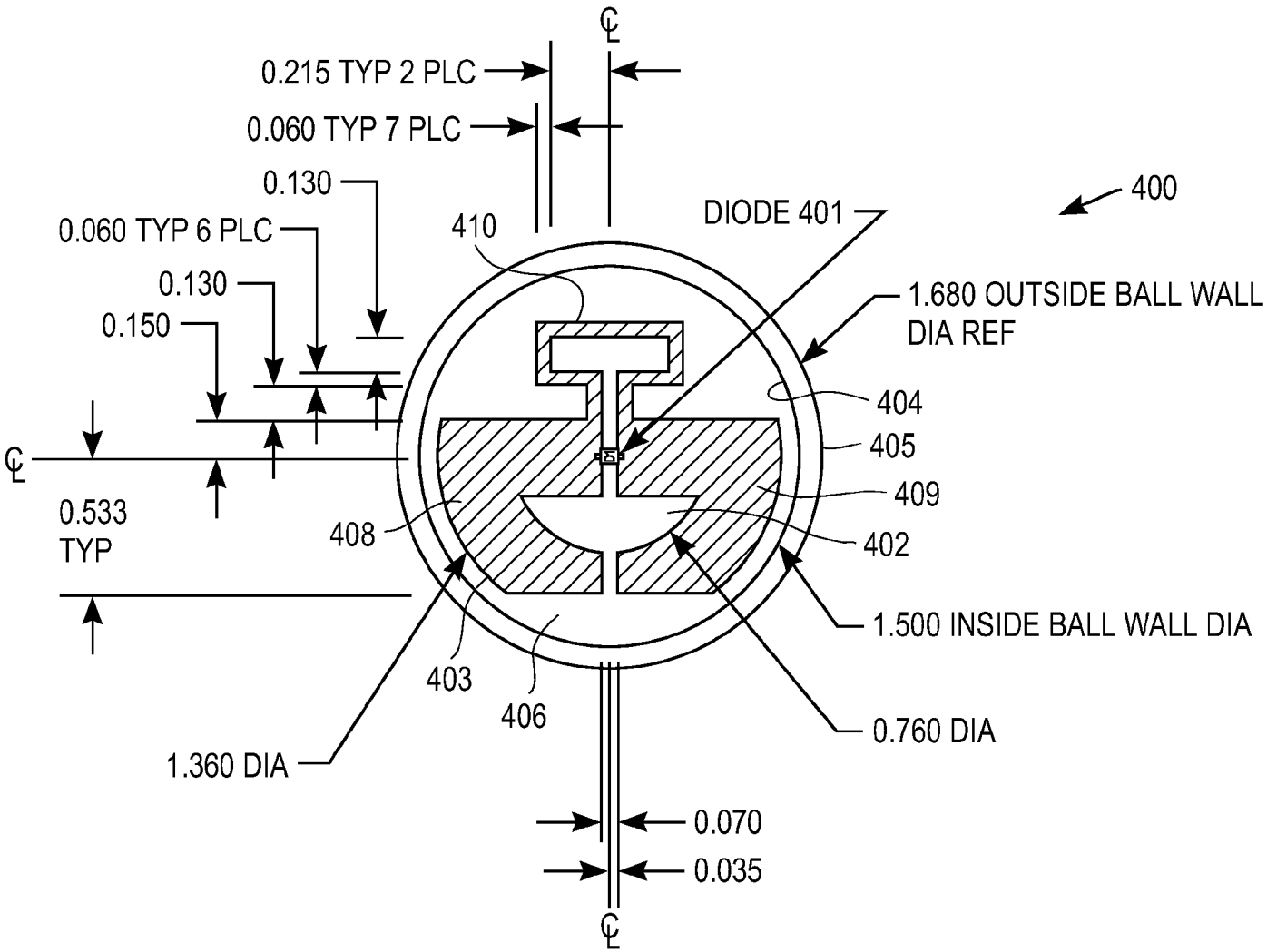
FIG. 5K shows a cross-sectional view of another embodiment of a golf ball of the invention.
Figure 5L:
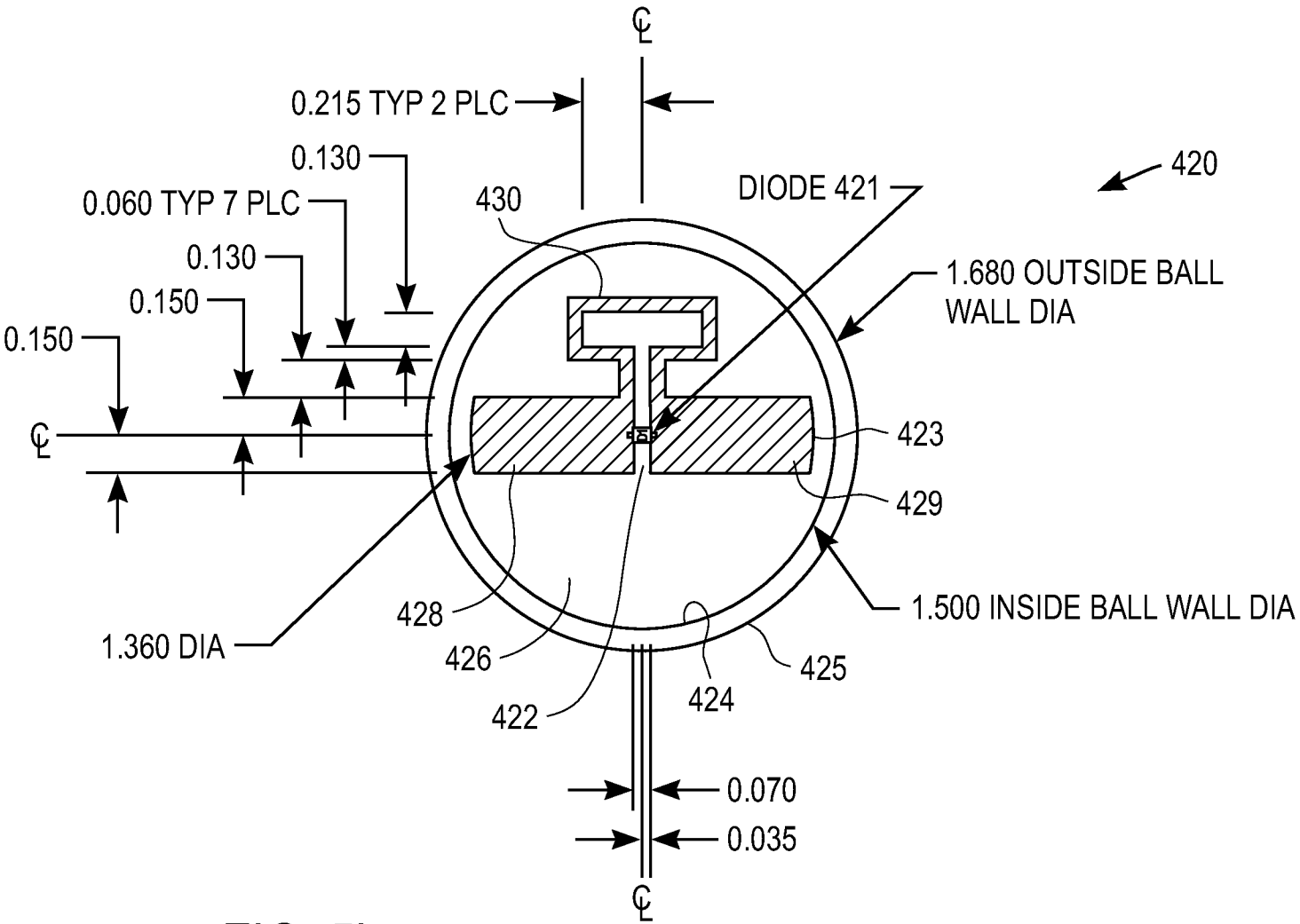
FIG. 5L shows a cross-sectional view of another embodiment of a golf ball of the invention.
Figure 5M:
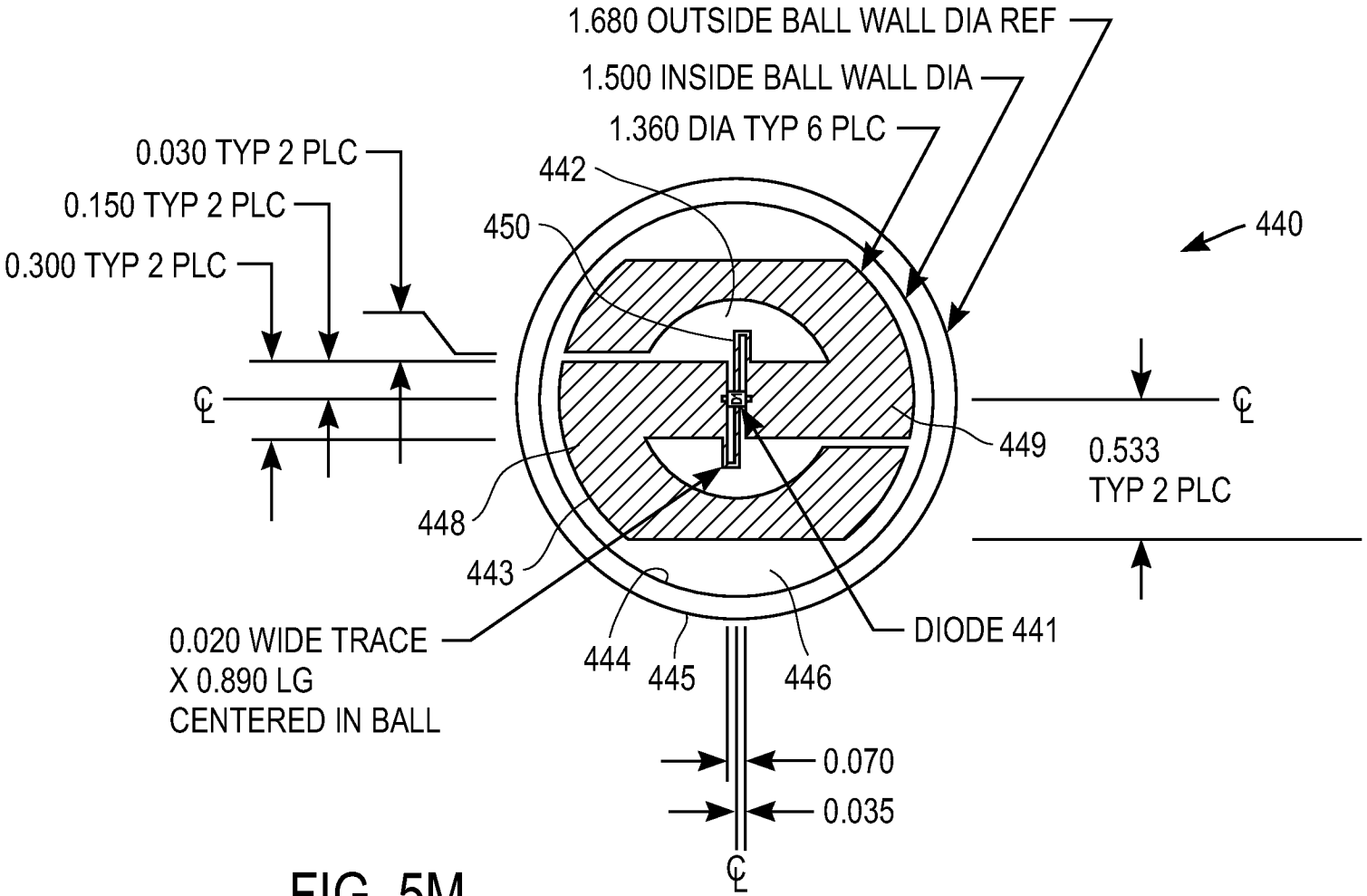
FIG. 5M shows a cross-sectional view of another embodiment of a golf ball of the invention.
Figure 5N:
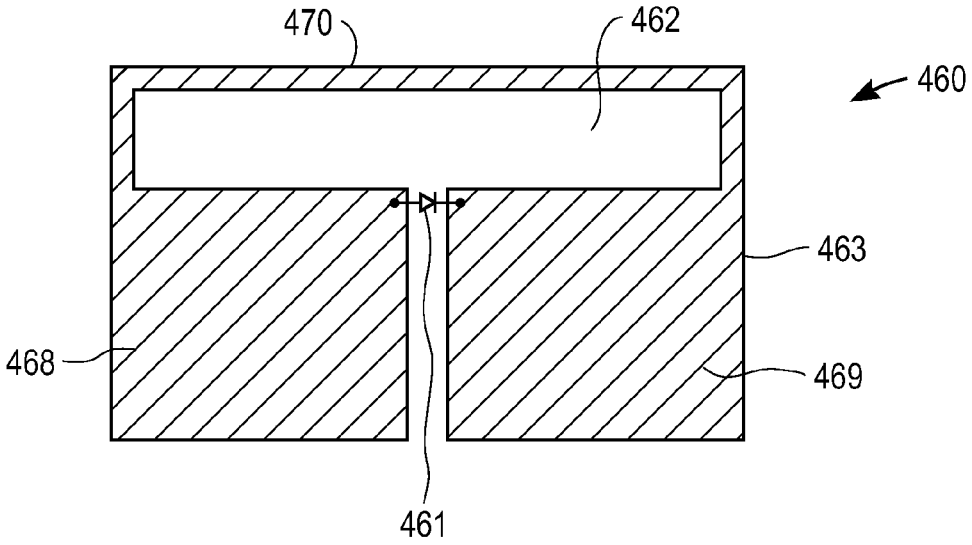
FIG. 5N shows a plain view of a tag which may be used in a golf ball according to one embodiment of the invention.
Figure 5O:
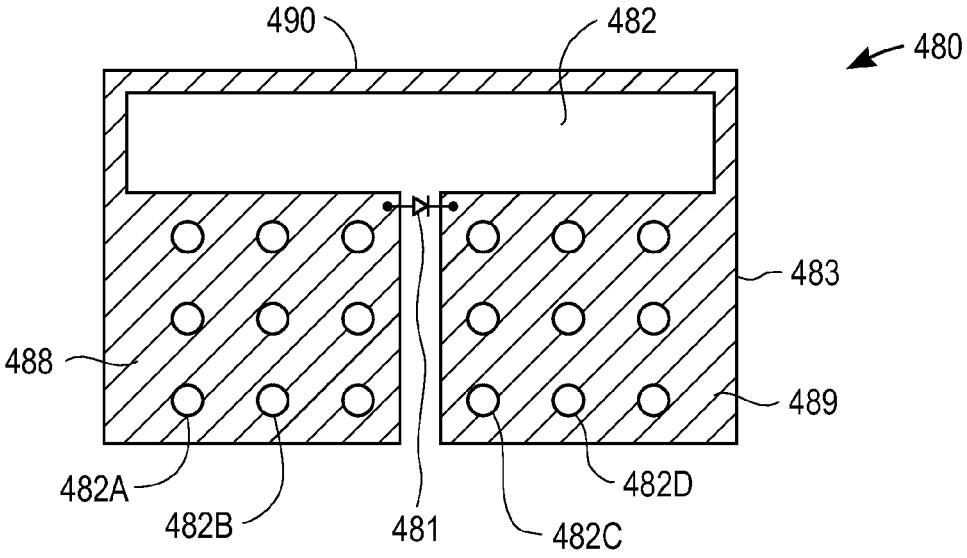
FIG. 5O shows a plain view of another tag which may be used in a golf ball according to one embodiment of the invention.
Figure 5P:
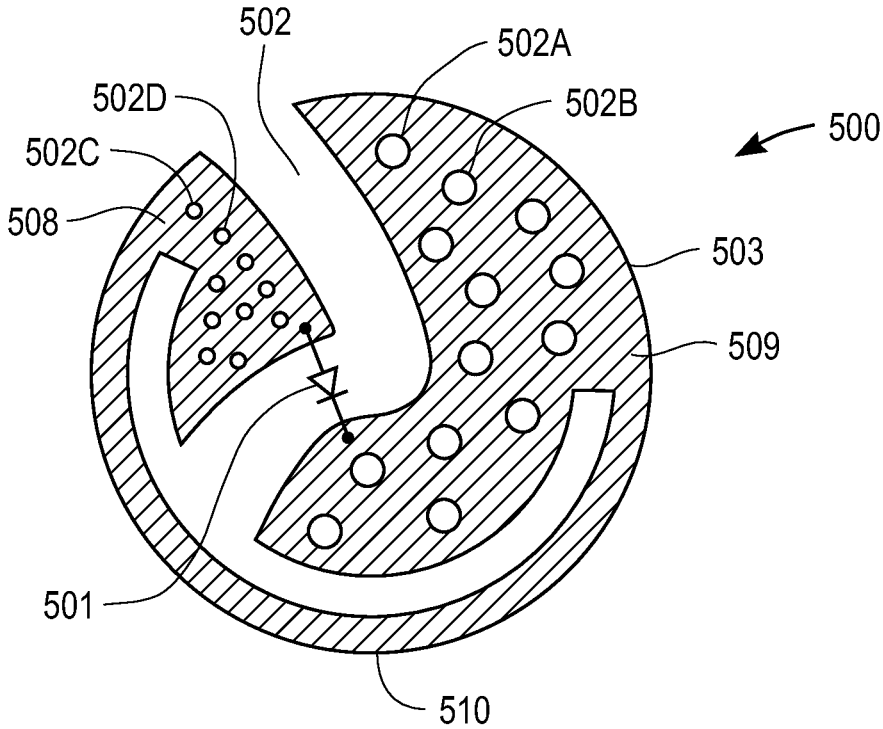
FIG. 5P shows a plain view of another embodiment of a tag which may be used in a golf ball according to one embodiment of the present invention.

FIGS. 5A through 5P show various golf ball components which include tags having various shapes and configurations which are alternative embodiments of the present invention. At least some of these embodiments share certain characteristics which will now be described before describing each of these particular embodiments in FIGS. 5A through 5P. In certain of the embodiments, the tag structure is substantially planar and symmetrical about a diametric axis which passes through the center of a golf ball. The tag structure is substantially in one plane which intersects (substantially) the center of the golf ball and has an outer perimeter which conforms to the inner contour (diameter) of the shell, which itself conforms to the outer diameter of the core in the case of the two-piece golf ball. The diode in certain embodiments is typically coupled to the antenna along the diametric axis. There is an internal void or perforation around a transmission line within certain embodiments of the tag. As can be seen from the various embodiments, the diode will be positioned either substantially at the center of the golf ball or substantially off-center. The diode in some embodiments is substantially near the center of the ball (e.g. FIGS. 5C and 5E) and in other embodiments it is not (e.g. FIGS. 3A and 4A). At least two types of transmission lines are shown having two distinct shapes; one case involves a "U" shaped portion which is bisected by the diametric axis of the golf ball, and another type of transmission line includes the "T" shaped transmission line which is also bisected by the diametric axis of the golf ball. Due to the perforations which exist in the tag, the surface area of the plane of the tag is less than the surface area of a cross-section through the center of the ball. Many of the embodiments described herein include an antenna which has a first wing and a second wing which is bisected by the diametric axis through the center of the golf ball. The first wing and the second wing are symmetrical and have at least one perforation which separates the first and second wings. A transmission line which is coupled to the first and second wings is substantially bisected by the diametric axis. At least a portion of the outer perimeter of the first and second wings substantially conforms to the outer diameter of the core material of the golf ball.

Various alternative embodiments of tags which may be used in golf balls will now be described while referring to FIGS. 5A through 5P. The golf ball component 200 shown in FIG. 5A shows a tag within a core 204 which then can be encased in the shell to form a golf ball. The tag includes a diode 201 which is contained within the core material 206. The tag is wholly contained within the outer perimeter of the core 204. The tag includes, in addition to the diode 201, a transmission line 210, and an antenna having antenna portions 208 and 209, which are coupled to the diode 201, and which are coupled to the transmission line 210 as shown in FIG. 5A. A central perforation, which is within the outer perimeter 203 of the tag, is surrounded by the antenna portions 208 and 209. Various exemplary dimensions are shown in FIG. 5A. While the tag of FIG. 5A has a transmission line of the same width as the transmission line of FIG. 3A, and while the diameter of the outer perimeter of the antenna of FIG. 5A is similar to the diameter of the outer perimeter of the antenna of FIG. 3A, the antenna is longer from top to bottom in FIG. 5A's embodiment than the embodiment of FIG. 3A.

FIG. 5B is another embodiment of a tag in a golf ball or golf ball core. The tag and core combination 220 includes an antenna having antenna portions 228 and 229 and a diode 221 which is coupled to the antenna portions 228 and 229. A perforation 222 centrally located within the outer perimeter 223 of the tag is also part of the tag's structure. The outer perimeter 224 of the core material completely surrounds the outer perimeter 223 of the tag. It can be seen that the outer perimeter 223 substantially conforms to the outer perimeter 224 of the core material. The embodiment shown in FIG. 5B does not include a transmission line. The view shown in FIG. 5B is a cross-sectional view taken at a plane which intersects the center of the core, wherein the plane which shows the view is parallel with the plane of the antenna having antenna portions 228 and 229. Thus, the position of the tag shown in FIG. 5B is similar to the position of the tag shown in FIG. 3A.

FIG. 5C shows another embodiment of a tag in a golf ball core. The core and tag combination 240 includes a diode 241 and antenna portions 248 and 249 which are connected to the diode 241. A perforation 242 extends along the diametric vertical axis as shown in FIG. 5C. This perforation is also within the outer perimeter 243 of the tag. There are also "V" shaped perforations between the spokes of the antenna portions 248 and 249. FIG. 5C shows a cross-sectional view of the tag within the core, and thus the view of FIG. 5C is the same as the view shown in FIG. 3A.

FIG. 5D shows another embodiment of the tag and core combination 260 which includes a diode 261 which is coupled to the antenna portions 268 and 269. These antenna portions surround the perforation 262, which is similar to the perforation 108 shown in FIG. 3A. The perforation allows for the core material 266 to extend through the perforation during the molding process described below. The outer perimeter 264 of the core material completely surrounds the tag shown in FIG. 5D.

FIG. 5E shows another embodiment of a golf ball 280 which includes a tag. The golf ball shown in FIG. 5E is a two-piece ball having a shell 285 which surrounds the outer perimeter 284 of the core material 286. The tag includes a diode 281 which is coupled between the two antenna portions 288 and 289. A transmission line 290 is also coupled between the two antenna portions 288 and 289. The tag includes at least one perforation 282 which is contained within the outer perimeter 283 of the tag. The view of FIG. 5E is a cross-sectional view wherein the plane of the view is parallel with the plane of the tag such that the view of FIG. 5E is similar to the view in FIG. 3A. The tag as shown in FIG. 5E is symmetrical about the centerline which coincides with a diametric axis of the golf ball which diametric axis intersects with the center of the golf ball. It can be seen from FIG. 5E that most of the outer perimeter 283 of the tag conforms substantially to the outer perimeter 284 of the core material 286. The tag shown in FIG. 5E is substantially planar and symmetric about the diametric axis which intersects the center of the golf ball. The "T" shaped transmission line 290 is bisected by this diametric axis. It can also be seen from FIG. 5E that the surface area of the plane of the tag is less than the cross-sectional area of a plane through the center of the ball. The perforation 282 allows for the core material 286 to be extruded through the perforations as a result of the molding process to produce a result which is similar to that shown in FIG. 3E.

FIG. 5F shows another embodiment of a golf ball 300 which is a two-piece golf ball including a shell 305 which surrounds the outer perimeter 304 of the core material 306. A tag is contained within the core material 306, and this tag includes a diode 301 which is coupled between antenna portions 308 and 309. The antenna portions 308 and 309 are coupled to a transmission line 310. The view of FIG. 5F is similar to the view shown in FIG. 3A, and is a cross-sectional view taken through the center of the golf ball. A perforation 302 exists between the two antenna portions and within the outer perimeter 303. Additionally, there are "V" shaped perforations between the spokes of the antenna portions. The dimensions shown in FIG. 5F, as well as all the other figures are in inches (except for of course the angular dimensions which are in degrees).

FIG. 5G shows another embodiment of a tag in a golf ball according to the present invention. The golf ball 320 is a two-piece golf ball which includes a shell 325 which surrounds the outer perimeter 324 of the core material 326. This golf ball may be formed in accordance with the method described below and shown in FIG. 7 and FIGS. 6A through 6D. The tag includes a diode 321 which is coupled between antenna portions 328 and 329. These antenna portions are coupled to a transmission line 330, and these antenna portions surround a perforation 322 which is similar to the perforation 136 shown in FIG. 4A and the perforation 108 shown in FIG. 3A. The perforation 322 is within the outer perimeter 323 of the tag. The view of FIG. 5G is a cross-sectional view taken through the center of the golf ball 320, and thus it is similar to cross-sectional view of FIG. 3A. The tag of FIG. 5G is substantially a planar tag which is symmetrical about the diametric axis which intersects the center of the golf ball 320. The outer perimeter 323 of the tag substantially conforms to the inner surface of the shell 325 and conforms to the outer surface of the core material 326. The "T" shaped transmission line 330 is bisected by the diametric axis, and the diode 321 is located near the center of the golf ball. As can be seen from FIG. 5G, the antenna portions 328 and 329 resemble first and second wings which are bisected by the diametric axis and which are symmetrical about this diametric axis. The perforation 322 separates the first and second wings. As in the case of the example shown in FIG. 3A, the perforation 322 allows for the core material 326 to be extruded through the perforation during the molding process described below to yield a result which is similar to that shown in FIG. 3E.

Another exemplary embodiment of a golf ball according to the present invention is shown in FIG. 5H, which is a cross-sectional view taken through the center of the golf ball 340 shown in FIG. 5H. The golf ball 340 is a two-piece golf ball which includes a shell 345 which surrounds the outer perimeter 344 of the core material 346. This golf ball 340 may be fabricated according to the process described below relative to FIGS. 6A through 6D and FIG. 7. The golf ball 340 includes a tag having a diode 341 which is coupled between antenna portions 348 and 349. A transmission line 350 is coupled between antenna portions 348 and 349. The perforation 342 is contained within the outer perimeter 343 of the tag, and additional perforations which are "V" shaped exist between the spokes of the antenna portions 348 and 349. The various linear dimensions shown in FIG. 5H indicate the sizes of the various components shown in FIG. 5H and are in inches. It can be seen that the tag structure of FIG. 5H is symmetrical about the diametric axis which intersects the center of the golf ball. The diode 341 is substantially near the center of the golf ball 340, and the tag structure is substantially planar. The ends of the spokes of the antenna portions form an outer perimeter 343 which substantially conforms to the outer surface 344 of the core material 346. The "T" shaped transmission line 350 is substantially bisected by the diametric axis which intersects the center of the golf ball 340.

Another exemplary embodiment of a golf ball according to the present invention is shown in FIG. 5I. FIG. 5I is a cross-sectional view where the plane of the cross-section is taken through the center of a golf ball 360. The golf ball 360 is a two-piece golf ball having a shell 365 which surrounds the outer surface or perimeter 364 of the core material 366. Contained within the core material 366 is a tag which includes a diode 361 which is coupled between antenna portions 368 and 369. An elongated transmission line 370 is coupled between the antenna portions 368 and 369. A perforation 362 exists between the antenna portions 368 and 369, an there are additional perforations which are "V" shaped between the spokes of the antenna portions. The perforations are within the boundary established by the outer perimeter 363 which is formed effectively by the ends of the spokes of the antenna portions.

Another exemplary embodiment of a golf ball according to the present invention is shown in FIG. 5J, which is a cross-sectional view, where the plane of the cross-section is taken through the center of the golf ball 380. The golf ball 380 is a two-piece ball having a shell 385 which surrounds an outer perimeter 384 of the core material 386. Wholly contained within the core material 386 is a tag which has antenna portions 388 and 389. The tag also includes a diode 381 which is coupled between the antenna portions 388 and 389, and further includes a transmission line 370 which is also coupled between the antenna portions 388 and 389. The perforation 382 exists between the two antenna portions 388 and 389, and this perforation is within the outer perimeter 383 of the tag as shown in FIG. 5J. This outer perimeter 383 substantially conforms to the outer perimeter 384 of the core material 386. The golf ball 380 may be fabricated according to the method described below relative to FIGS. 6A through 6D and FIG. 7.

FIG. 5K shows another exemplary embodiment of a golf ball according to the present invention. The golf ball 400 shown in FIG. 5K is a two-piece golf ball which includes a shell 405 which surrounds the outer perimeter 404 of the core material 406. Wholly contained within the core material 406 is a tag which includes an antenna portion 408 and an antenna portion 409. The tag also includes a diode 401 which is coupled between the two antenna portions 408 and 409. A transmission line 410 is also coupled between the two antenna portions 408 and 409. A perforation 402 exists between the two antenna portions 408 and 409 and is contained within the outer perimeter 403 of the tag. The golf ball 400 will be fabricated according to one of the methods described below such that the core material 406 is extruded through the perforation 402 to produce a result which is similar to that shown in FIG. 3E. It can be seen from FIG. 5K that the tag is substantially symmetrical about a diametric axis which intersects the center of the golf ball 400. The tag is substantially planar and includes a "T" shaped transmission line which is also bisected by the diametric axis. In this embodiment, the diode 401 is located substantially at the center of the golf ball 400.

FIG. 5L shows another exemplary embodiment of a golf ball of the present invention. The golf ball 420 shown in FIG. 5L is a two-part golf ball including a shell 425 which surrounds an outer perimeter 424 of a core material 426. The core material 426 wholly contains a tag which includes a diode 421 and two antenna portions 248 and 249 and the transmission line 430. The diode 421 is coupled between the two antenna portions 428 and 429, and the transmission line 430 is coupled between the two antenna portions 428 and 429. The perforation 422 between the antenna portions separate the antenna portions and is similar to the perforation 108 of FIG. 3A. In addition, the transmission line 430 includes a perforation. These perforations are within the outer perimeter 423 defined by the ends of the antenna portions. The golf ball 420 may be fabricated according to one of the embodiments described below for a method of fabricating a golf ball. Thus, the extrusion of the core material 426 through the perforations will result in a structure which is similar to that shown in FIG. 3E. The tag of FIG. 5L is a substantially planar tag which is symmetrical about the diametric axis of the golf ball, which diametric axis intersects the center of the golf ball 420. The T-shaped transmission line 430 is bisected by the diametric axis, and the tag structure is symmetrical about this diametric axis which coincides with the vertical center line shown in FIG. 5L. FIG. 5L is a cross-sectional view where the plane of the cross-section is taken through the center of the golf ball 420 and thus it resembles the view shown in FIG. 3A.

FIG. 5M shows another exemplary embodiment of a golf ball according to the present invention. The golf ball 440 is a two-piece golf ball which includes a shell 445 which surrounds an outer perimeter 444 of the core material 446. In the cross-sectional view of FIG. 5M, it can be seen that the tag includes a diode 441 and antenna portions 448 and 449 as well as a transmission line 450. The diode 441 is coupled between the two antenna portions 448 and 449, and the transmission line 450 is coupled between these two antenna portions. At least one perforation 442 exists within the outer perimeter 443 of the tag, where the outer perimeter 443 is defined by the outer edge or perimeter of the antenna portions. The cross-sectional view of FIG. 5M is in a plane which intersects the center of the golf ball, and the tag structure is substantially planar and symmetrical about a diametric axis of the golf ball which intersects the center of the golf ball. The golf ball 440 shown in FIG. 5M may be fabricated according to the methods described below such that the core material 446 is extruded through the perforations 442 during the molding process to yield a structure which is similar to that shown in FIG. 3E.

FIG. 5N shows an exemplary embodiment of a tag of the present invention. The tag 460 includes antenna portions 468 and 469 and a diode 461 which is coupled between these antenna portions. A transmission line 470 is coupled to the antenna portions 468 and 469, and this transmission line 470 surrounds the perforation 462, which perforation separates the transmission line from the antenna portions 468 and 469. There is also a separation between the antenna portions which may also be a perforation. The tag of FIG. 5N may be made small enough in its rectangular shape so that it fits completely within the core material of a two-piece golf ball. Alternatively, portions of the antenna portions 468 and 469 may be trimmed away to allow this tag to fit within a golf ball core or within a one-piece golf ball. The tag shown in FIG. 5N is a substantially planar tag which may be placed in a plane in the golf ball core which intersects with the center of the golf ball. In this position, the substantially planar tag of FIG. 5N will be symmetrical about the diametric axis of the golf ball, which diametric axis intersects the center of the golf ball. The tag of FIG. 5N may be introduced into a core material to fabricate a golf ball according to one of the methods described below relative to FIGS. 6A-6D and FIG. 7.

FIG. 5O shows another exemplary embodiment of a tag which may be used in golf balls of the present invention. Tag 480 is similar to the tag 460 except it includes additional perforations in the antenna portions 488 and 489. The tag 480 includes a diode 481 which is coupled between the antenna portions 488 and 489 and includes a transmission line 490 which is coupled between the antenna portions, in which, together with the antenna portions, defines the perforation 482. In addition to the perforation 482, nine circular perforations on each of the antenna portions provide additional openings for the core material to be extruded through the perforations, such as perforations 482A, 482B, 482C, and 482D.

FIG. 5P shows another exemplary embodiment of a tag which may be used in golf balls of the present invention. The tag 500 is a substantially circular tag which is also substantially planar. The tag includes a diode 501 coupled between antenna portions 508 and 509. The outer perimeter 503 of the tag 500 is substantially circular and includes a perforation 502 within the outer perimeter 503. A transmission line 510 is coupled between the antenna portions 508 and 509. In addition to the perforation 502, perforations of different sizes are included on the antenna portions 508 and 509. In particular, smaller perforations 502C and 502 are on the antenna portion 508, while larger perforations such as perforations 502A and 502B are on the antenna portion 509. The tag 500 may be included in a golf ball core and fabricated according to the techniques described below. The perforations in this tag will allow for the core material to be extruded through the perforations to create a structure similar to that shown in FIG. 3E.

Figure 6A:
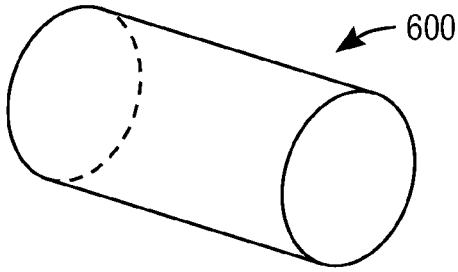
FIGS. 6A, 6B, 6C, and 6D show diagrammatically one embodiment of a method for making a golf ball of the present invention.
Figure 6B:
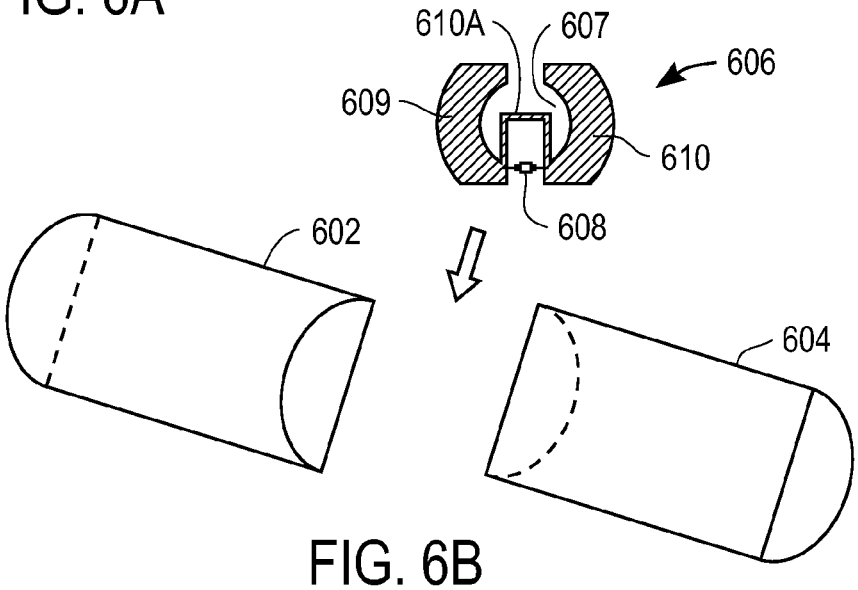
Figure 6C:
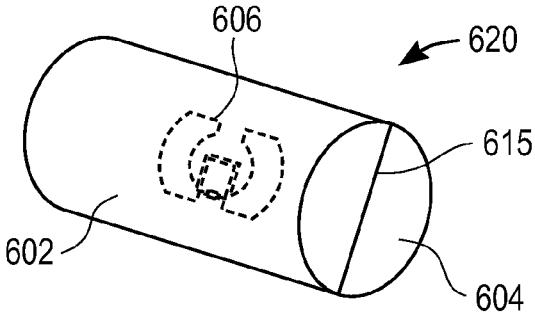
Figure 6D:
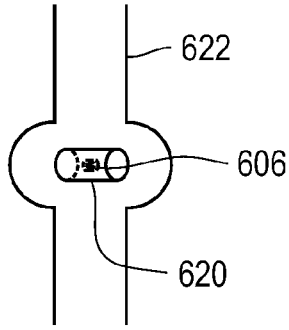

FIG. 6A through 6D and FIG. 7 will now be referred to while describing various embodiments of methods of fabricating golf balls of the present invention. The following discussion assumes a two-piece ball having a core material which is surrounded by a relatively thin shell, such as the golf ball shown in FIG. 3A. It will be appreciated, however, that the following discussion will also apply to one-piece golf balls and to golf balls having more than two pieces. The one exemplary method shown in FIGS. 6A-6D begins with a cylindrical-shaped slug 600 which, in one embodiment, is about 1.375 inches high and has a diameter of 1.125 inches. The cylindrical-shaped slug is typically a rubber composition which has not been vulcanized. Examples of such compositions are described in U.S. Pat. Nos. 5,508,350 and 4,955,613. In the example shown in FIG. 6A and 6B, the slug 600 is sliced in half to create slug portions 602 and 604. In certain embodiments, the material of the slug 600 is an unvulcanized rubber which is extruded to form the shape of the slug 600. It will be appreciated that this is one method of forming the two portions as shown in operation 702 of FIG. 7. In an alternative embodiment, these two portions may be formed separately as two separately extruded pieces or in some other manner to create the two separate portions separately rather than from a single slug such as slug 600. These two portions may be considered golf ball precursor portions. After the two portions are created, such as portions 602 and 604, a tag such as tag 606 is placed between the two portions. The tag 606 typically will include antenna portions 609 and 610 between which are coupled a diode 608. The tag 606 may also include a transmission line 610A which is disposed in the central perforation 607. The tag 606 may be similar to the tag shown in FIG. 4A. Once the tag 606 is placed between the two portions 602 and 604, these portions are brought together to create the combined structure 620 as shown in FIG. 6C. The combined structure 620 includes the seam 615 which separates the two portions 602 and 604. The tag 606 is sandwiched between the two portions, preferably in the middle of these two portions, so that the tag will end up being substantially centered in the final core. The seam 615 may not be sealed or glued together; that is, the two portions 602 and 604 may not be held together by glue in the configuration shown in FIG. 6C. Typically, the extruded, unvulcanized rubber (which may be used in certain embodiments) of the two portions has enough tackiness to hold together the tag and two portions 602 and 604. After the structure shown in FIG. 6C is obtained, the combined structure 620 is placed in a mold 622 as shown in FIG. 6D and as described in operation 706 of FIG. 7. The mold is of a proper size to form a resulting core size of about 1.5 inches in diameter. The core will typically weigh in the range of about 34.75 to 35.25 grams. After the combined structure 620 is placed within the mold 622, the slug is molded, typically in a high temperature and high pressure operation. This molding operation, due to the high temperature and high pressure, vulcanizes and cures the rubber composition from the two slug portions into one unit and also causes this composition to flow through the perforations in the tags to create a unitary structure, such as the structure shown in FIG. 3E. In one exemplary embodiment, the core rubber composition is vulcanized/cured for eight minutes at a temperature of 325° Fahrenheit under a high pressure clamping of about 2 tons per square inch. In other embodiments of a method of the invention, the molding temperature can be in the range from about 200° F. to about 350° F. and the molding pressure can be in the range from about 1,000 pounds per square inch (psi) to about 5,000 psi and the period of time can be in a range from about 1 minute to about 15 minutes. After the molding process of operation 708, the core is allowed to cool overnight at room temperature and then the surface is cleaned prior to injection molding of the cover material, such as shell 102 of FIG. 3A, over the core. Examples of suitable cover material are known in the art, including materials which are described in U.S. Pat. No. 5,538,794. After encasing the molded core into a shell as in operation 710 of FIG. 7, the ball may be processed in finishing operations which involve ball trimming, surface cleaning, stamping/logo application and painting. As noted elsewhere, embodiments of the invention may be used in golf balls constructed as one-piece balls or more than 2 piece balls (e.g. balls having more than one core).

Figure 6E:
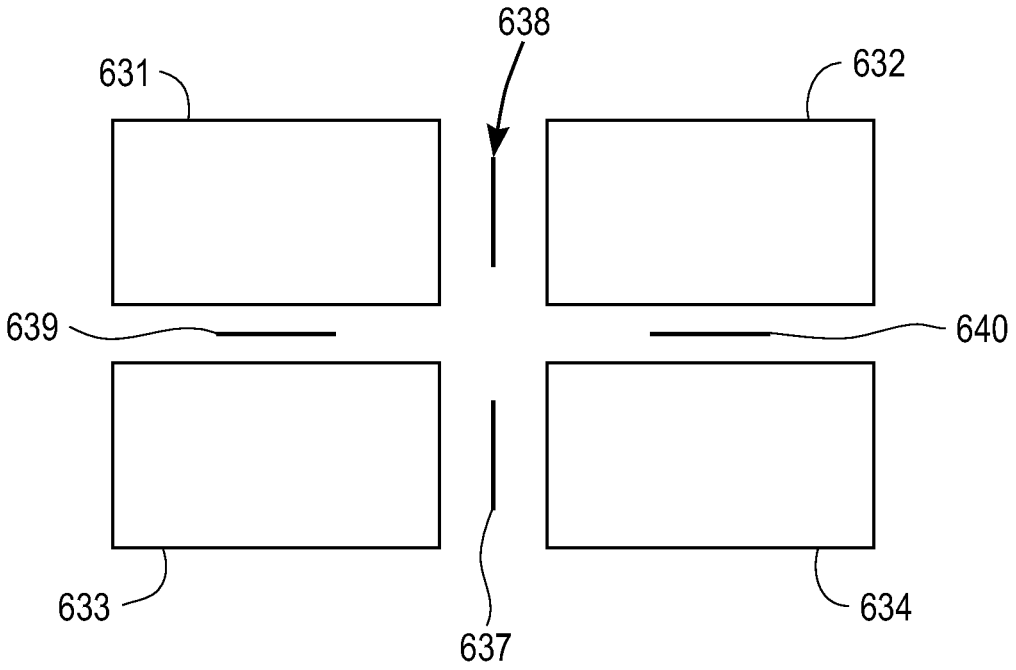
FIG. 6E shows another embodiment of a method of making a golf ball.
Figure 7:
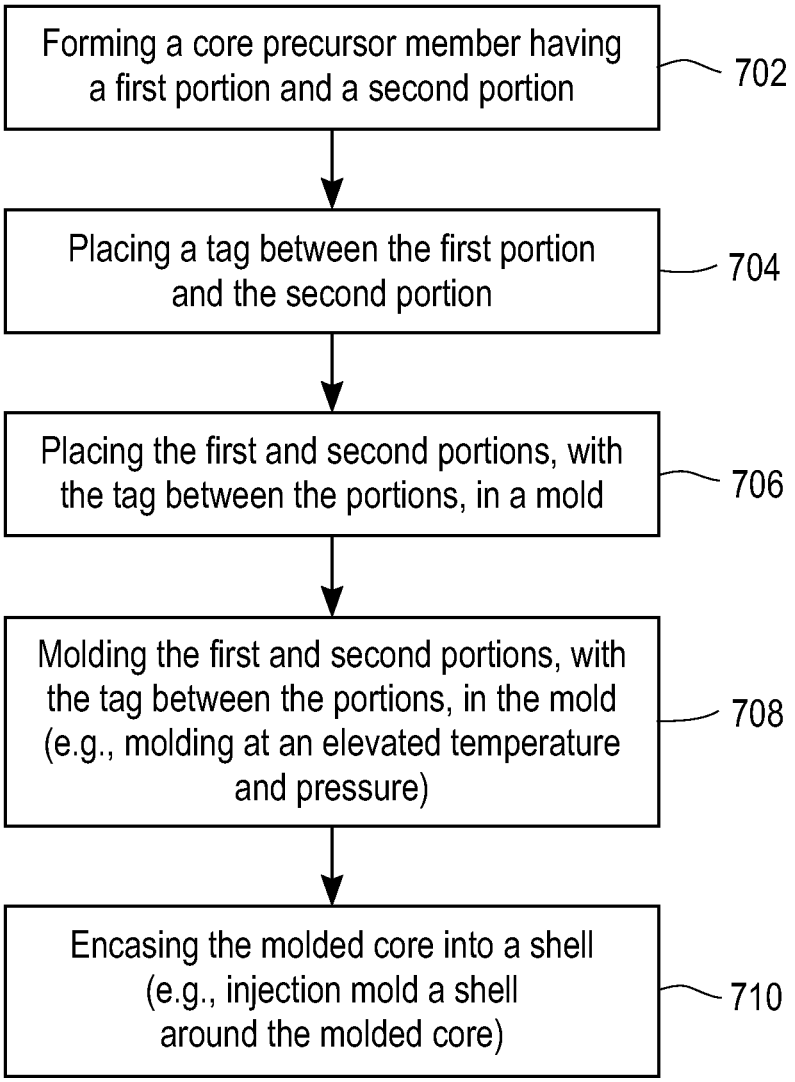
FIG. 7 shows a flow chart of one exemplary process for making a golf ball of the present invention.

While several of the examples described herein show the slicing or forming of two slug portions (e.g. 602 and 604 in FIG. 6B or 1202 and 1204 in FIG. 10B), it will be recognized that more than two slug portions may be combined together with one or more tags to form a golf ball. For example, a cylindrically shaped slug (such as the slug 600 in FIG. 6A) may be sliced into four pieces which are then combined with a tag or two tags or four tags to create an assembly which is similar to structure 620 and which can then be molded into a golf ball or golf ball core. The four pieces may each be half cylinders which have equal sizes. These four pieces may alternatively be separately formed by an extruder to create the four pieces rather than slicing a larger cylindrical slug. These four pieces may receive four tags between the inner faces of the pieces. FIG. 6E shows, in an exploded top view, an example of four slug portions 631, 632, 633 and 634 receiving four tags 637, 638, 639 and 640; this assembly is, after the tags are inserted, placed into a molding chamber to form the golf ball (in the case of a one-piece golf ball construction) or a core of a golf ball (in the case of a more than one piece golf ball construction).

Figure 8A:
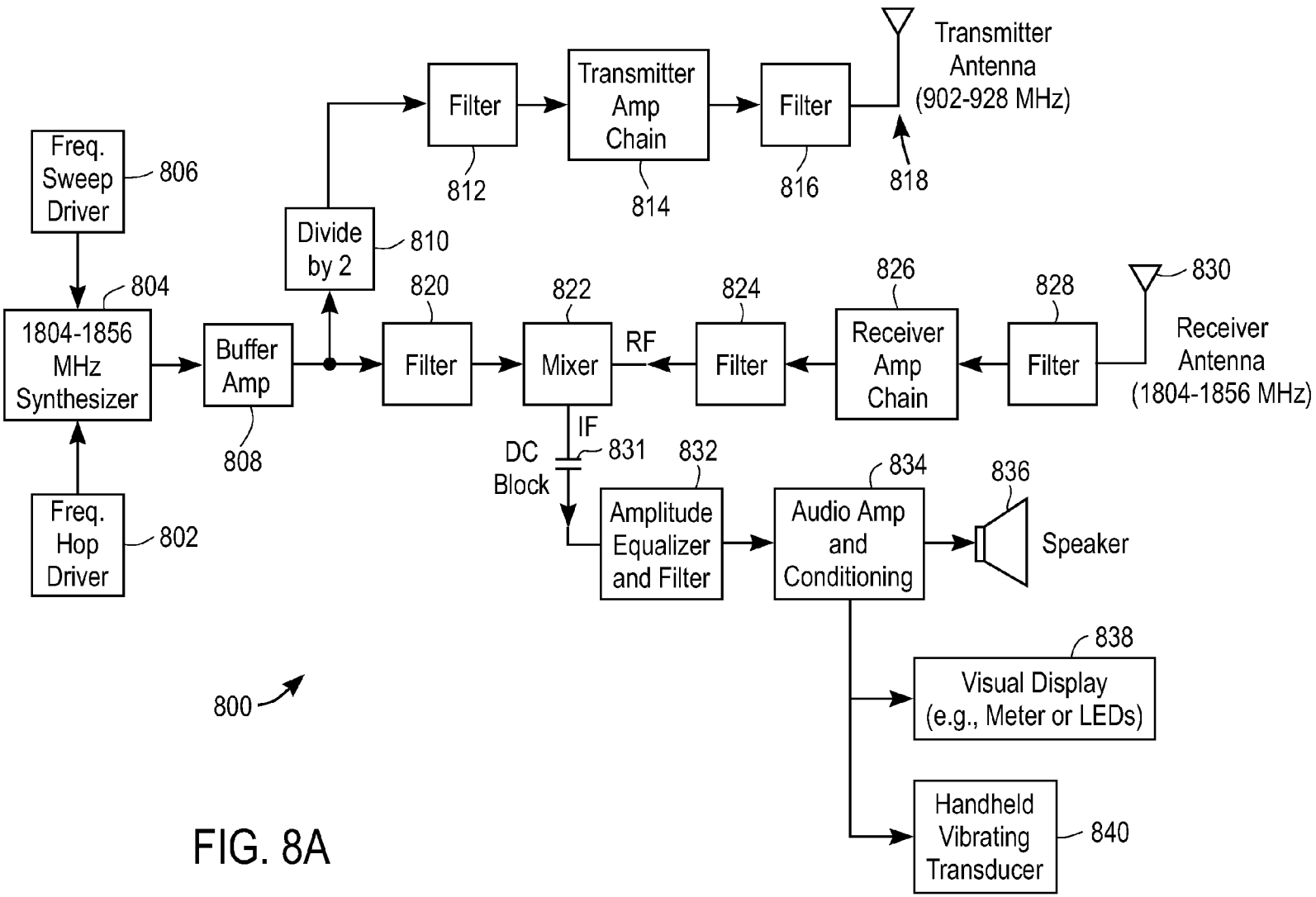
FIG. 8A shows a block diagram schematic of a handheld transmitter/receiver of one embodiment of the present invention.
Figure 8B:
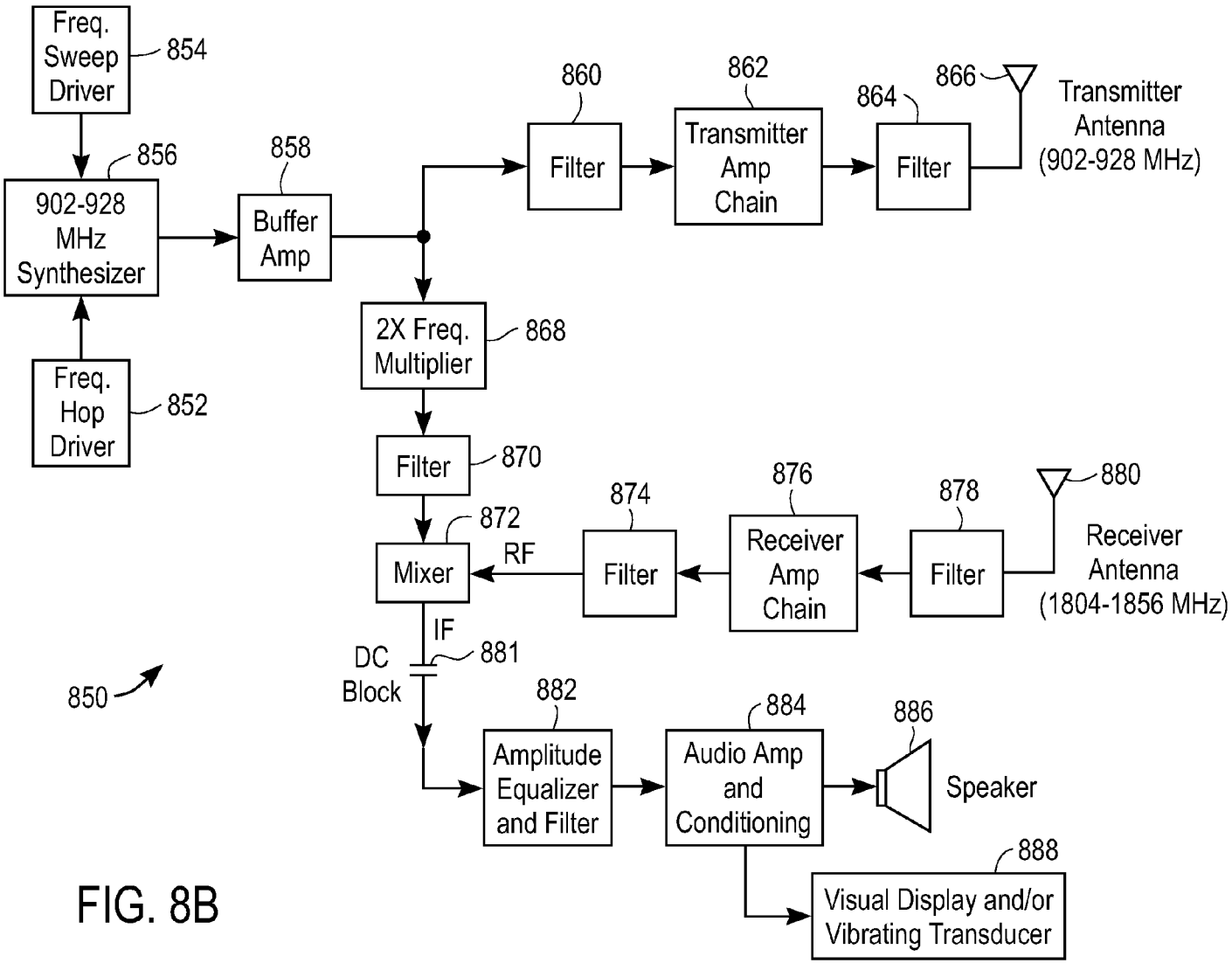
FIG. 8B shows a block level schematic representation of an embodiment of a transmitter/receiver.
Figure 8C:
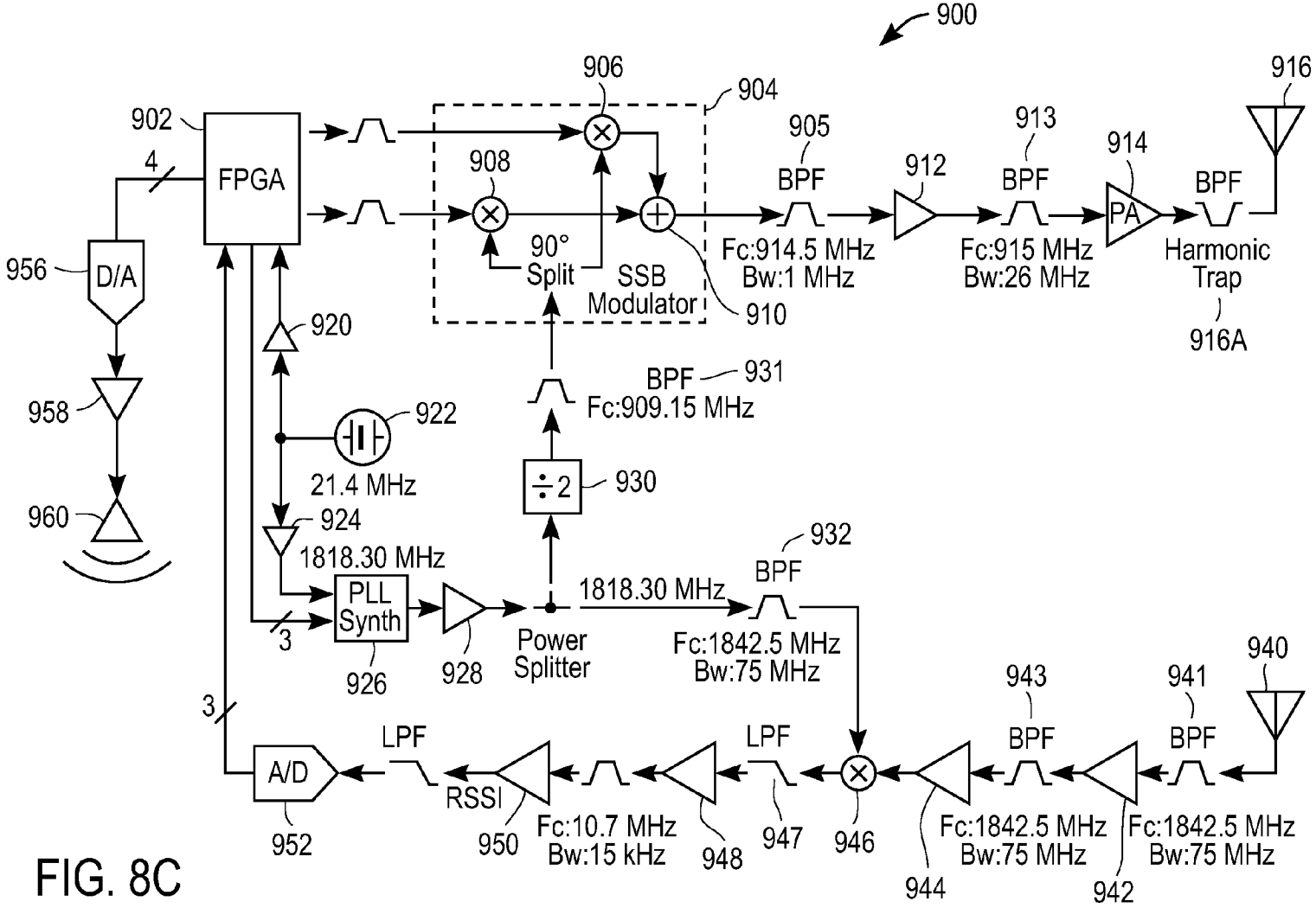
FIG. 8C shows a block level schematic of an embodiment of a handheld transmitter/receiver of the present invention.

A description of various embodiments of a handheld transmitter/receiver which may be used as the handheld unit 14 of FIG. 1A will now be provided in conjunction with FIGS. 8A, 8B, and 8C. In the exemplary embodiments of FIGS. 8A, 8B and 8C, the handheld unit consists of a battery powered transmitter and antenna radiating the radio frequency signal in the 902-928 MHz band, and an antenna and a receiver operating over the 1804-1856 MHz band, and an audio and visual interface to the user of the handheld unit. The audio interface may optionally be an earphone rather than a speaker, and as an option, the handheld unit may utilize a vibrating transducer to alert the user to the presence of a ball. A visual display such as a meter or a string of LEDs may also provide a proximity measure to the user so that the user can tell whether or not the user is getting closer to the ball or further from the ball as the user walks around searching for the ball.

The handheld unit 800 shown in FIG. 8A includes a battery powered transmitter and battery powered receiver and an audio and visual interface. The implementation shown in FIG. 8A uses a frequency-hopping transmitted signal that complies with the Federal Communications Commission Rules Part 15.247 for intentional radiators. The radio frequency transmitted signal originates in the synthesizer 804 which is an oscillator at twice the transmitted frequency which receives a frequency sweeping sawtooth modulation from a sweep driver 806. The synthesizer 804 also receives a control from the hopping-implementing synthesizer driver 802 which causes the synthesizer to hop from frequency to frequency within the band 1804-1856 MHz. The output from the synthesizer 804 is amplified by the buffer amplifier 808 and directed to a divide-by-two divider 810, the output of which is directed to a filter 812. The output from the filter 812 is directed to a transmitter amplifier chain 814 which provides an output to a filter 816 which in turn provides an output to the transmitter antenna 818, thereby transmitting the radio frequency signal in the range of 902-928 MHz. The transmitter antenna is moderately directive and produces the radiated signal which can be reflected by a tag in a lost golf ball. The diode in the tag causes the reflected signal to have double of the frequency of the received signal, which received signal was emitted by the transmitter antenna. The proximity of the handheld unit to the golf ball will in large part determine the magnitude/intensity of the reflected signal which can then be indicated by one of the user interfaces such as the speaker or earphones or visual display or the vibrating transducer in the handheld unit.

The receiver of the handheld unit 800 includes a moderately directive receiver antenna 830 which receives the reflected second harmonic signal produced by the diode in the lost golf ball. This received signal is filtered in filter 828 which provides the filtered output to a receiver amplifier chain 826 which amplifies the filtered signal, which is then outputted to a further filter, filter 824, the output of which is directed to a mixer 822. The mixer 822 also receives the filtered output of the amplifier 808 through the filter 820. The output of the mixer 822 is an audio frequency difference product of the second harmonic of the frequency swept transmitter signal, and the signal received from the frequency-doubling tag within the ball. The audio frequency difference product has a pitch that is determined by the sweeping of the transmitter frequency and the time delay between the transmitted and received signals. Thus, the pitch of the audio frequency difference product provides an indication of the distance between the handheld unit and the lost golf ball. The audio frequency difference product from the mixer is provided through a DC block 831 which provides the output (filtered for DC level) to an amplitude equalizer and filter 832 which provides an output to an audio amplifier and conditioner 834 which drives the speaker 836. A visual display 838 is also coupled to the amplifier and conditioner 834 to provide a visual display of the proximity of the golf ball and then optional handheld vibrating transducer 840 may provide a vibrating output, the intensity of the vibration increasing as the ball approaches the handheld unit. It will be appreciated that any particular handheld unit may have one or more of these indicators. For example, it may have only a speaker or a headphone output or it may have only a visual display or only a vibrating display or it may have two or more of these outputs.

The handheld unit 850 of FIG. 8B is similar in structure and operation to the handheld unit 800 except that the frequency synthesizer 856 operates in the band 902-928 MHz rather than double that frequency as in the case of synthesizer 804. Accordingly, there is no divide-by-two divider in the handheld unit 850 but rather there is a 2× frequency multiplier 868 in the handheld unit 850. The handheld unit 850 is an implementation that uses a frequency-hopping transmitted signal that complies with the FCC Rules Part 15.247 for intentional radiators. The radio frequency transmitted signal originates in the frequency synthesizer 856 which is an oscillator at the transmitted frequency which receives a frequency sweeping sawtooth modulation from a sweep driver 854. The synthesizer 856 is controlled by a frequency hop driver 852. The oscillator output from synthesizer 856 is amplified by the buffer amplifier 858 which provides an output to the filter 860 and an output to the frequency doubler 868. The output from the amplifier 858 is filtered in filter 860 and amplified in the transmitter amplifier chain 862 and then filtered in filter 864 to produce a transmitted signal which is transmitted from the moderately directive transmitter antenna 866 in the band of 902-928 MHz. This transmitted signal may be reflected by a tag, causing a reflected signal at a double harmonic (twice the frequency) of the received signal from the transmitter antenna. The receiving antenna 880 picks up this reflected second harmonic and provides this received signal to the filter 878 which provides an output to a receiver amplifier chain 876 which provides an output to a filter 874. Thus the received signal is filtered and amplified and provided as an RF input to the mixer 872 which also receives a filtered input from the 2× frequency multiplier 868. The mixer 872 produces at its output an audio frequency difference product of the second harmonic of the frequency swept transmitter signal and the signal received from the frequency-doubling tag within the ball. The audio frequency difference product has a pitch that is determined by the sweeping of the transmitter frequency and the time delay between the transmitted and received signals. This audio frequency difference product is output through a DC block 881 to an amplitude equalizer and filter 882 which in turn outputs a signal to the audio amplifier and conditioner 884 which drives the speaker 886. In addition, the amplifier and conditioner 884 provides an output to a visual display and the vibrating transducer 888.

FIG. 8C shows another embodiment for a handheld unit which consists of a battery powered transmitter and an antenna radiating at about 915 MHz, and an antenna and receiver operating at about 1829 MHz. The implementation of FIG. 8C uses a direct sequence spread spectrum radar system which includes the transmitter and a receiver and a control unit, which in this case is a field programmable gate array (FPGA). The basic clock signal for the FPGA 902 is obtained from the local oscillator 922 which provides inputs to the amplifiers 920 and 924 which in turn drive the FPGA 902 and a phase-locked loop synthesizer 926. During a power-on operation, the FPGA 902 programs the phase-locked loop synthesizer 926 to the correct frequency of operation. This occurs through the control lines from the FPGA 902 to the phase-locked loop synthesizer 926. The phase-locked loop synthesizer 926 is used to generate a local oscillator (LO) signal for the receiver. A receiver LO frequency is 1818.30 MHz. A frequency divider 930 is used to generate a 909.15 MHz local oscillator for the transmitter which is filtered by a band pass filter 931 (centered at 909.15 MHz ("FC")). Deriving the transmit local oscillator from the receiver's local oscillator not only eliminates the requirement for a second phase-locked loop synthesizer, but virtually eliminates any frequency error (e.g. frequency drift) between the transmitter and the receiver. The transmit local oscillator is modulated using a Quadrature Modulator circuit. This Quadrature Modulator enables a single circuit to perform all of the following features: (1) it performs a basic On-Off Keyed (OOK) modulation used in radar systems. Operating with OOK modulation not only provides an audio tone for the system but also minimizes the heat generated by the amplifiers and the transmitter, such as amplifiers 912 and 914; (2) the Quadrature Modulator produces a Binary Phase-Shift Keying (BPSK) modulation of the local oscillator signal and performs what is called a Direct-Sequence Spread Spectrum signaling. This allows the handheld unit to operate in the 915 MHz industrial, scientific and medical (ISM) and as a license-free device operated under FCC Part 15.247; (3) the Quadrature Modulator 904 provides a Single-Sideband translation of the local oscillator input signal to a transmit output frequency of 914.50 MHz. That is, the local oscillator signal is shifted up in frequency by 5.35 MHz. This frequency translation results in a received signal that is offset from the receiver's local oscillator frequency by 10.7 MHz. Having the received frequency that is offset from the receiver's local oscillator reduces the magnitude of unwanted local oscillator leakage into the receiver's high gain amplifier chain, which may include amplifiers 942 and 944 and 948 as shown in FIG. 8C. The output of the Quadrature Modulator 904, which includes multipliers 906 and 908 as well as the mixer 910, is a Direct-Sequence, Spread Spectrum signal containing OOK modulation at a frequency of 914.5 MHz. This signal is filtered by two band pass filters 905 and 913 and amplified by two amplifiers 912 and 914 to approximately 1 watt and is sent to a transmit antenna 916. The transmit antenna also has a harmonic trap 916A, which is used to further reduce any second harmonic distortion, which if radiated, would interfere with the received signal from the tag in a lost golf ball. The Quadrature Modulator 904 is controlled by the FPGA 902 which provides and generates a Pseudo-Random Binary Sequence used for the Direct-Sequence Spread Spectrum signal. The FPGA 902 also provides and produces the OOK control signals to the modulator 904 and generates and provides the In-Phase and Quadrature-Phase signals applied to the Quadrature Modulator 904.

An alternative embodiment for the handheld unit shown in FIG. 8C is to change feature (1) of the Quadrature Modulator to implement 90-degree phase shift keying at the audio tone frequency, instead of On-Off keying. Features (2), Direct-Sequence Spectrum Spreading, and (3), Single-Sideband translation remain the same. The FPGA 902 produces the 90-degree phase shift keying signal applied to the Quadrature Modulator 904. When the tag in the golf ball doubles the transmitted frequency from 914.5 MHz to 1829 MHz, the tag also doubles the amount of phase shift keying modulation to 180-degree keying. The re-radiated signal is active 100% of the time, instead of nominally half-time for On-Off keying, and the receiver has twice as much signal energy to process in the FPGA, A/D converter, and Post Demodulation processing. Thus the maximum useable range for finding the tag-equipped golf ball is increased, with a related increase in power drain on the battery.

The receiver of the handheld unit 900 operates on the principle that the tag in the golf ball will produce a harmonic reflected signal, which in one embodiment, doubles the transmitted frequency of 914.5 MHz to a reflected signal of 1829 MHz which re-radiates this doubled signal back to the receiver of the handheld unit. When a BPSK signal is squared, the modulation is removed and the energy in the modulated sidebands is collapsed back into a single spur at a frequency twice the carrier frequency. Thus the target (e.g. a tag in a lost golf ball) not only performs frequency doubling (or generating some other harmonic), but in the process, despreads the signal for free, eliminating the requirement for despreading circuitry in the receiver of the handheld unit. Therefore, what is re-radiated from the tag in the golf ball is an OOK modulated signal at 1829 MHz. The receiver receives this re-radiated (reflected) signal at the receive antenna 940 and filters and amplifies this 1829 MHz signal through the amplifiers 942 and 944 and the band pass filters 941 and 943. Thus, the received signal from antenna 940 is filtered in band pass filter 941 which outputs its filtered signal to the amplifier 942 which outputs its filtered signal to the amplifier 942 which outputs an amplified signal to the band pass filter 943 which outputs a filtered signal to the amplifier 944 which outputs a signal to the mixer 946. The other input to the mixer 946 is the received local oscillator signal at a frequency of 1818.3 MHz which is received from the band pass filter 932. The mixer 946 performs a down-conversion to a 10.7 MHz intermediate frequency (IF) by multiplying the amplified 928 MHz signal received from amplifier 944 by the local oscillator signal of 1818.3 MHz received from the band pass filter 932. This multiplication (also called mixing) produces two signals, one at the sum frequency of 1347.3 MHz and the other at the difference frequency of 10.7 MHz. The sum frequency is filtered out by the 10.7 MHz intermediate frequency filter 947 which provides an output to the amplifier 948. This intermediate frequency filter 947 has a very small bandwidth (15 kHz) that also eliminates most of the received noise and adjacent RF (Radio Frequency) interference. What remains out of the intermediate frequency is a 10.7 MHz, OOK modulated signal that is amplified by amplifier 948 and further amplified by an amplifier 950 which includes a generator circuit 950 that generates a Receive Signal Strength Indicator (RSSI). This RSSI generator is not unlike an amplitude modulation (AM) detector, but with a logarithmic amplitude response. This RSSI function removes the 10.7 MHz carrier, resulting in just the audio tone that was applied to the signal in the transmitter. An 8-bit analog-to-digital (A/D) converter 952 converts the RSSI signal to a sampled digital signal. This digitized signal then undergoes post-demodulation signal processing in the FPGA 902 to further enhance the signal by reducing the noise by as much as 20 dB. This post-demodulation signal processing is performed by a Synchronous Video Generator (SVI) which performs an Exponential Ensemble Average across multiple OOK radar bursts. The FPGA 902 is programmed to include the SVI which is used for the post-demodulation signal processing. The FPGA 902 converts the output of the SVI circuit back to audio, which is amplified by an amplifier 958 which drives a speaker or headphones 960. The digital-to-analog converter 962 may be used in conjunction with the FPGA 902 to convert the digital audio output to an analog output for purposes of driving the speaker 960 or headphones. Optionally, a series of LEDs or a meter driven by the digital-to-analog converter 956 may also provide a visual indication of the proximity of the golf ball to the user of the handheld unit 900.

Figure 8D:
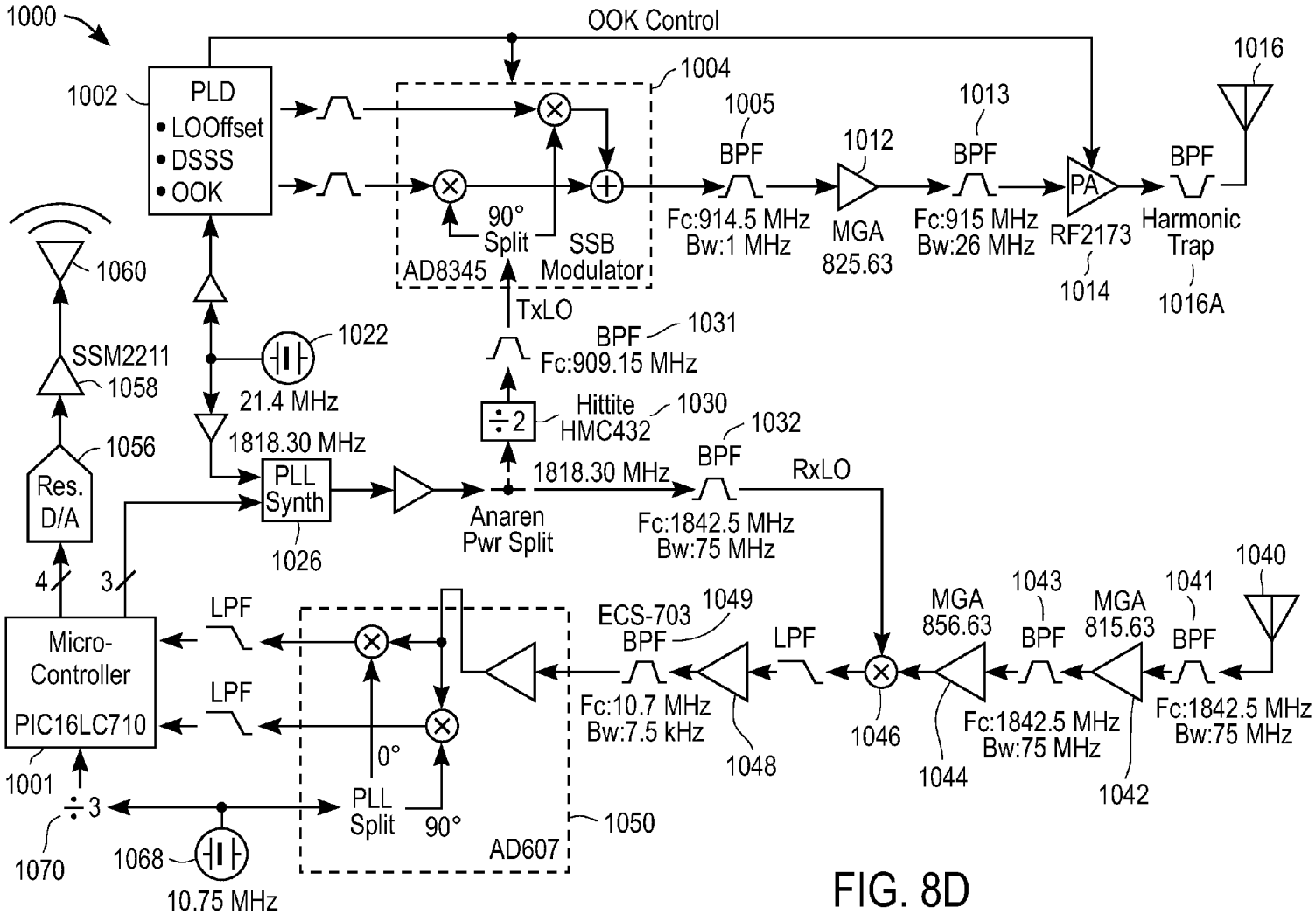
FIG. 8D shows a block-level schematic of an embodiment of a handheld transmitter/receiver of the present invention.

FIG. 8D shows another embodiment for a handheld unit which consists of a battery powered transmitter and an antenna radiating at about 915 MHz and an antenna and a receiver operating at about 1829 MHz. The handheld unit 1000 of FIG. 8D is similar in some ways to handheld unit 900 of FIG. 8C. The handheld unit 1000 includes band pass filters 1005 and 1013 and amplifiers 1012 and 1014 in the transmitter portion of unit 1000. In addition, this transmitter portion includes a transmit antenna 1016 which receives the amplified signal produced by amplifiers 1012 and 1014 through a harmonic trap 1016A. The transmitted signal originates from a crystal oscillator 1022 and phase locked loop synthesizer 1026 which produce a signal at a reference frequency of about twice the transmitted signal. A divide-by-two frequency divider 1030 and a band pass filter (BPF) 1031 provide the transmitter local oscillator signal to signal generator 1004 which is controlled by the PLD (Programmed Logic Device) 1002. The output of the signal generator 1004 drives the amplifiers 1012 and 1014, and the amplifier 1014 is controlled by OOK control from PLD 1002. This OOK control pulses the transmitter on and off, in one embodiment, with an On duty cycle of 50% or less. This will save battery life and minimize heat generated in the transmitter. The transmitter may also include an adaptive power control which could extend battery life (and simplify the handheld's user interface). When no signal is detected and when the receive signal strength is more than adequate for detection, the unit could scale back the transmit power automatically, thus conserving battery power and freeing the user from having to adjust a power transmit control knob. The receiver portion of the handheld unit includes receiver antenna 1040 which is coupled to BPF 1041 which in turn is coupled to amplifier 1042. The output of amp 1042 drives amp 1044 through BPF 1043. The mixer 1046, which receives the output of amp 1044, down converts this output to a 10.7 MHz intermediate frequency signal which is amplified (in amp 1048) and filtered (in BPF 1049) and then processed by amplifier 1050 (which may be an Analog Devices AD 607 amplifier which generates an RSSI signal). The amplitude of the received signal may be measured by a Cordic transform in microcontroller 1001. The RSSI signal is converted by an Analog to Digital converter in the microcontroller 1001 which in turn drives a D/A converter and an amplifier and speaker 1060 (or some other appropriate output device).

Several three-dimensional tags having a substantial surface area in more than one plane will now be described by referring to FIGS. 9A through 9H and 10A and 10C. It will be appreciated that these are some of many possible examples of three-dimensional tags, and it will be appreciated that the previously described planar tags may be formed to have a substantially non-planar shape in the manner described below.

Figure 9A:
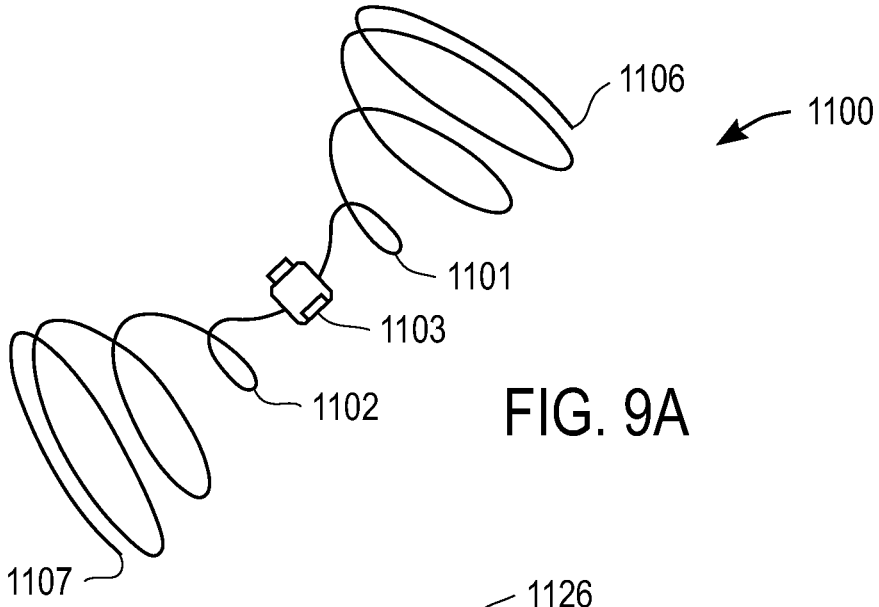
FIG. 9A shows an exemplary embodiment of a tag having a spiral antenna.

FIG. 9A shows an example of a spiral tag 1100 having a first spiral antenna portion 1101 and a second spiral antenna portion 1102 which are coupled together through the diode 1103. The spiral antenna portion 1102 includes an end 1107, and the spiral antenna portion 1101 includes an end 1106. In the case of the tag 1100, the winding direction through both antenna portions is maintained, as can be seen by beginning at the end 1107 and following the direction of the winding of the antenna portion 1102 through and into the antenna portion 1101, and ultimately arriving at the end 1106 while maintaining the same winding direction through both of these spiral antenna portions.

Figure 9B:
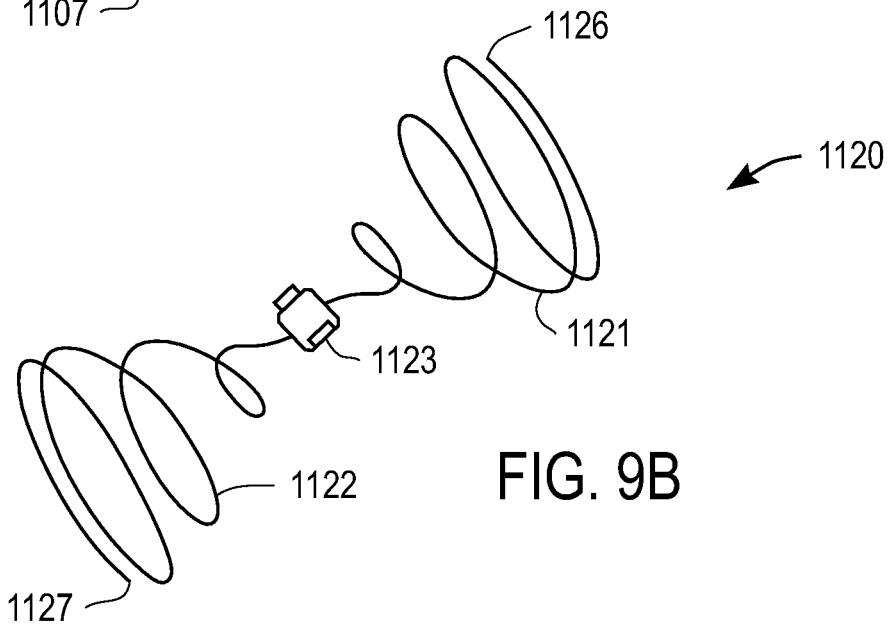
FIG. 9B shows an exemplary embodiment of another tag having a spiral antenna.
Figure 9C:
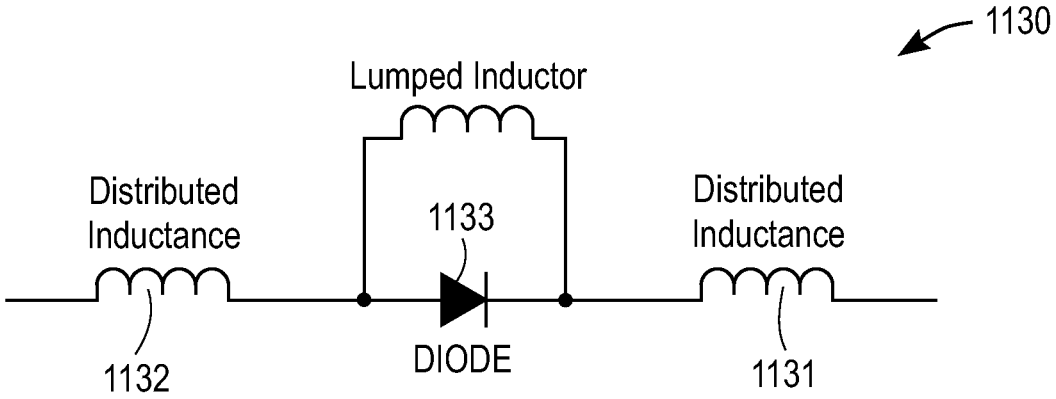
FIG. 9C is an electrical schematic showing the circuit formed by a tag having a spiral antenna.

The example of the spiral antenna 1120 shown in FIG. 2B is a case where the first and second antenna portions are mirror images or complements of each other; thus the winding direction is reversed between the two antenna portions 1121 and 1122. These antenna portions are coupled together by the diode 1123 as shown in FIG. 9B. The complement or mirror image nature of the two spiral antenna portions can be seen by beginning at the end 1127 and winding in a winding direction of the spiral antenna portion 1122, which is an opposite winding direction relative to the spiral antenna portion 1121, where the winding begins at the end 1126. An electrical schematic of the spiral tags 1100 and 1120, as well as the other spiral tags shown in FIGS. 9D through 9H, is shown in FIG. 9C. The tag 1130 of FIG. 9C includes a diode 1133 which is coupled between antenna portions 1131 and 1132. An inherent inductor, as shown in FIG. 9C, is coupled in parallel across the diode 1133. The tag 1130 works in a manner which is similar to the tag shown in FIG. 2A, except that such a tag has substantial surface area in more than one plane. The multiplanar or three-dimensional tag described herein has improved findability relative to a tag which is substantially in one plane (e.g. such as the tag shown in FIG. 3A) due to the fact that single-plane tags have dead spots. An example of a dead spot is when the tag lands in an orientation in which the plane of the tag is perpendicular to the waves which are transmitted from the handheld unit (see the signal 16 which is represented as waves originating from the handheld transmitter).

The spiral tags described herein, such as spiral tags 1100 and 1120, allow for the diode to be located near the center of the ball, which is desirable for protection from shock and for meeting golf ball flight and balance requirements. The structure of these tags provides greater cross-sectional areas in all planes, and this provides better performance than a single-planar tag which might land in an orientation where very little of the transmitted power is received by such a single-planar tag. The structures of the spiral antenna portions naturally form an ideal shape for shock absorption. It will be appreciated that control of the winding radius and pitch may be used to create a structure which is resonant of both the transmit (e.g. 915 MHz) and receive (e.g. 1830 MHz) frequencies.

Figure 9D:
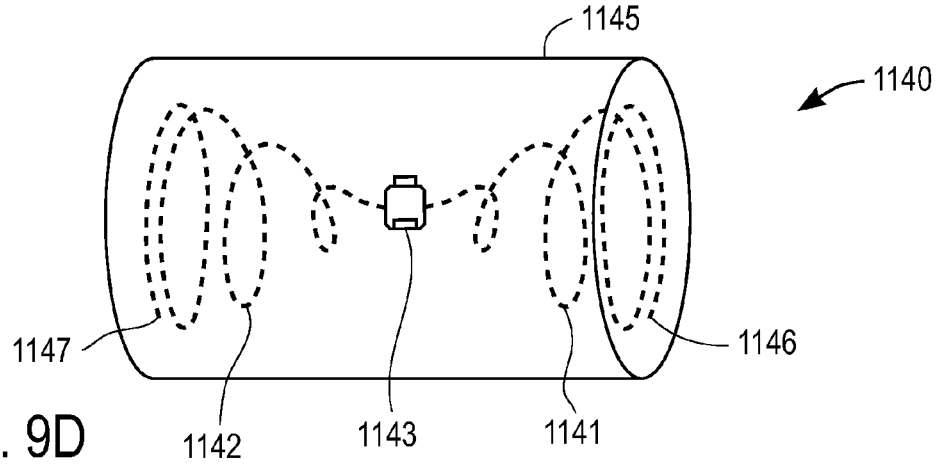
FIGS. 9D, 9E and 9F show various examples of tags having spiral antennas which have been placed within a slug which is to be molded to form a golf ball core.
Figure 9E:
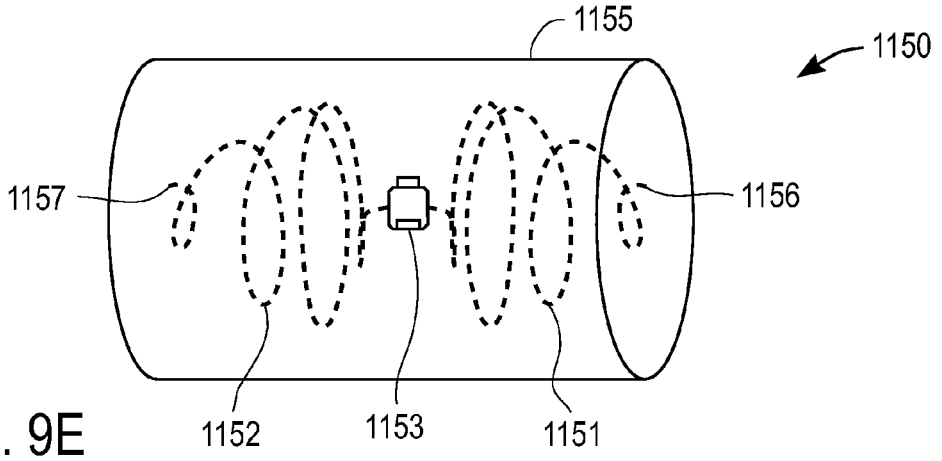
Figure 9F:
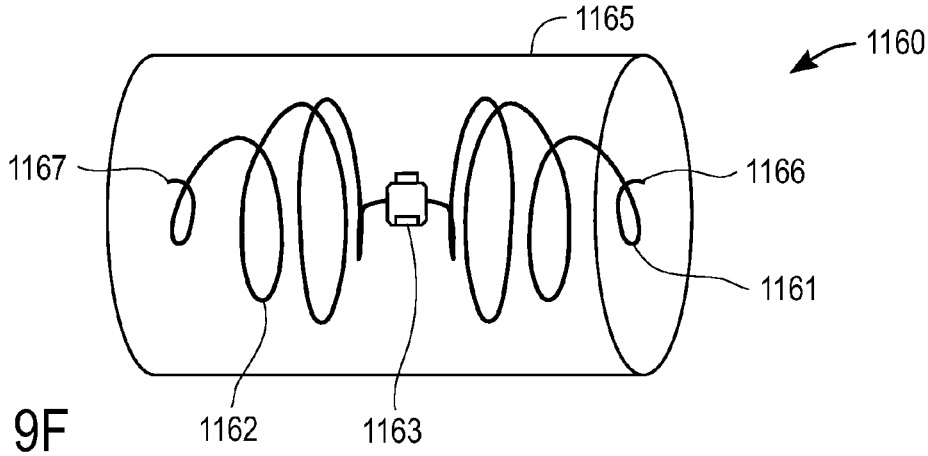

FIGS. 9D, 9E and 9F show examples of spiral tags which are contained within slugs which are used to form golf ball cores. These slugs are similar to the slug shown in FIG. 6C which includes the tag 606. The slugs shown in FIGS. 9D, 9E and 9F may be formed by extruding the ball material around the spiral tag or by inserting the spiral tag into a void or cutout in each half-portion of a slug. After the spiral tag has been placed within the slug, then the combination may be molded in a high pressure and high temperature vulcanization process which is similar to that described relative to FIG. 6D above. This vulcanization process or molding process creates the spherical golf ball core which can then be encased in a shell as described above.

The slug assembly 1140 includes a spiral tag having a diode 1143 which is coupled between spiral antenna portions 1141 and 1142. This spiral tag is similar to the spiral tags shown in FIGS. 9A, 9B and 9C. The spiral tag is included or encased within the slug material 1135 in an extrusion operation described above or by inserting the spiral tag into a void between two half-portions of the slug material 1145. In the case of FIG. 9E, the spiral tag has the spiral antenna portions or windings inverted as shown in FIG. 9E, with the diode 1153 coupled between these antenna portions 1151 and 1152. The spiral tag is encased within the slug material 1155 to form the slug assembly 1150 shown in FIG. 9E. The spiral tag of FIG. 9E is electrically similar to the circuit shown in FIG. 9C. The spiral tag in the slug assembly 1160 of FIG. 9F is the same as the spiral tag shown in FIG. 9E except that the spiral antenna portions are formed from flat wire (see, for example, FIG. 9G) relative to the cylindrical wire used in FIG. 9E (see, for example, FIG. 9H). The slug assembly 1160 has a spiral tag which includes the diode 1163 which is coupled between spiral antenna portions 1162 and 1161 which are formed out of flatter wire than the spiral antenna portions 1151 and 1152. The spiral tag of FIG. 9F is included within slug material 1165 to form this slug assembly 1160. It will be recognized that these spiral tags have perforations within their outer perimeters which allow a material to flow through the tag (e.g. in a molding operation).

Figure 9G:
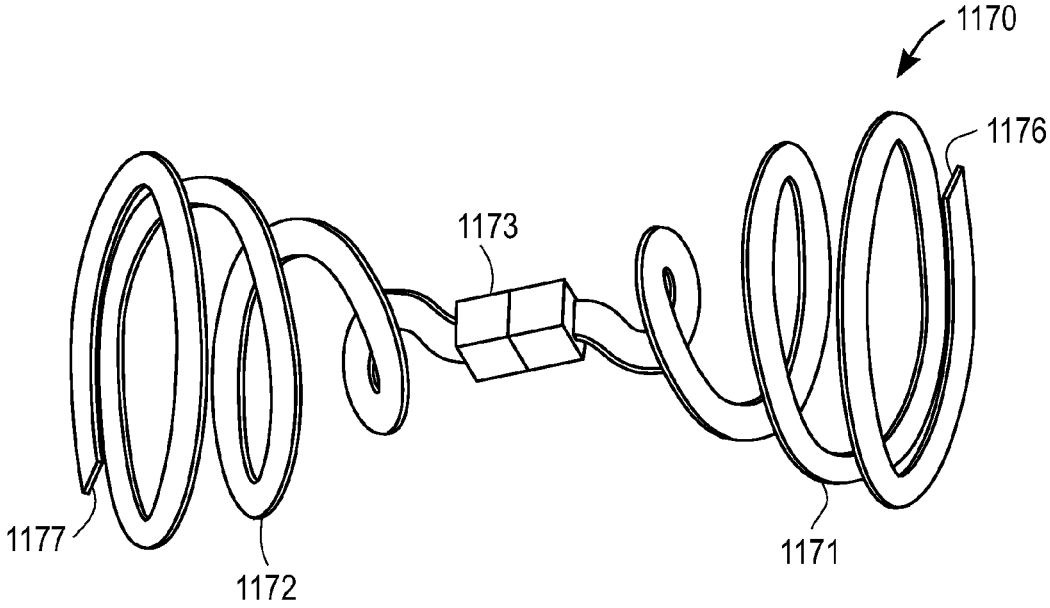
FIG. 9G shows another exemplary embodiment of a tag having a spiral antenna.
Figure 9H:
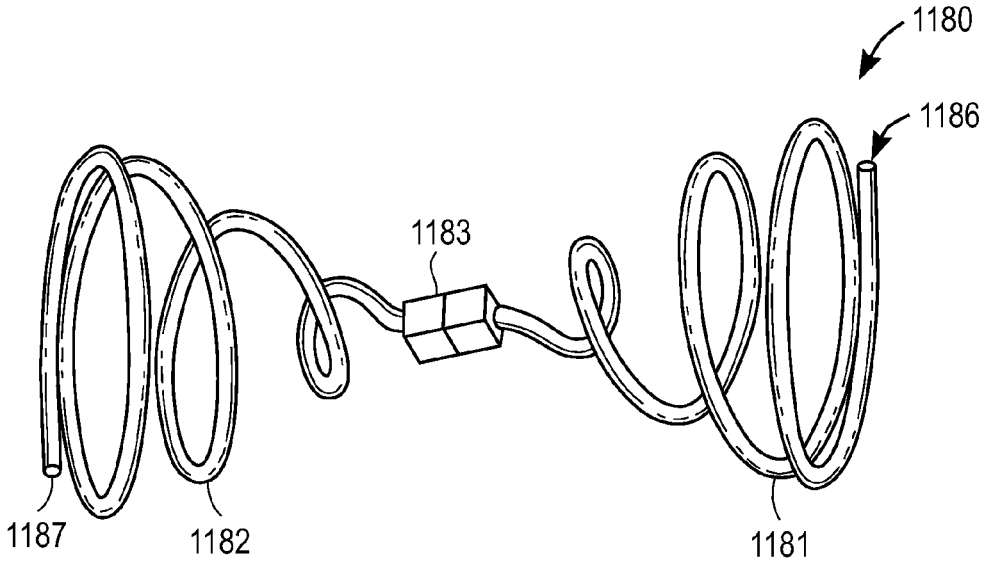
FIG. 9H shows another exemplary embodiment of a tag having a spiral antenna.

The difference between the types of wires which may be used for the spiral antenna portions is shown in FIGS. 9G and 9H. In the spiral tag of FIG. 9G, the diode 1173 couples together flat wire antenna portions 1172 and 1171, which have been formed into spiral antenna portions. This tag 1170 is electrically similar to the tag shown in FIG. 9C. The tag 1180 shown in FIG. 9H includes a diode 1183 coupled between spiral antenna portions 1181 and 1182. This tag 1180 is electrically similar to the tag shown in FIG. 9C. The tag 1180 uses wire which has a cylindrical cross-section rather than the flat wire shown in the tag 1170 of FIG. 9G.

Figure 10A:
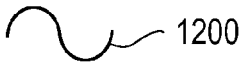
FIG. 10A shows an example in a top view of a three-dimensional tag having, in this case, a shape which resembles the letter "S."
Figure 10B:
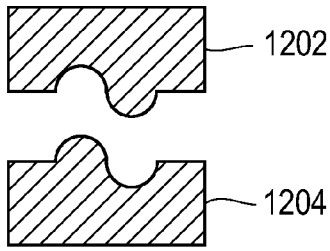
FIG. 10B shows an embodiment of a slug which has been cut or formed in order to receive the tag of FIG. 10A. A view of FIG. 10B is a top view showing the two portions of the slug.
Figure 10C:
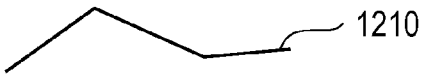
FIG. 10C shows another example of a three-dimensional tag. A view of FIG. 10C is a top view, which resembles a cross-sectional view.
Figure 13:
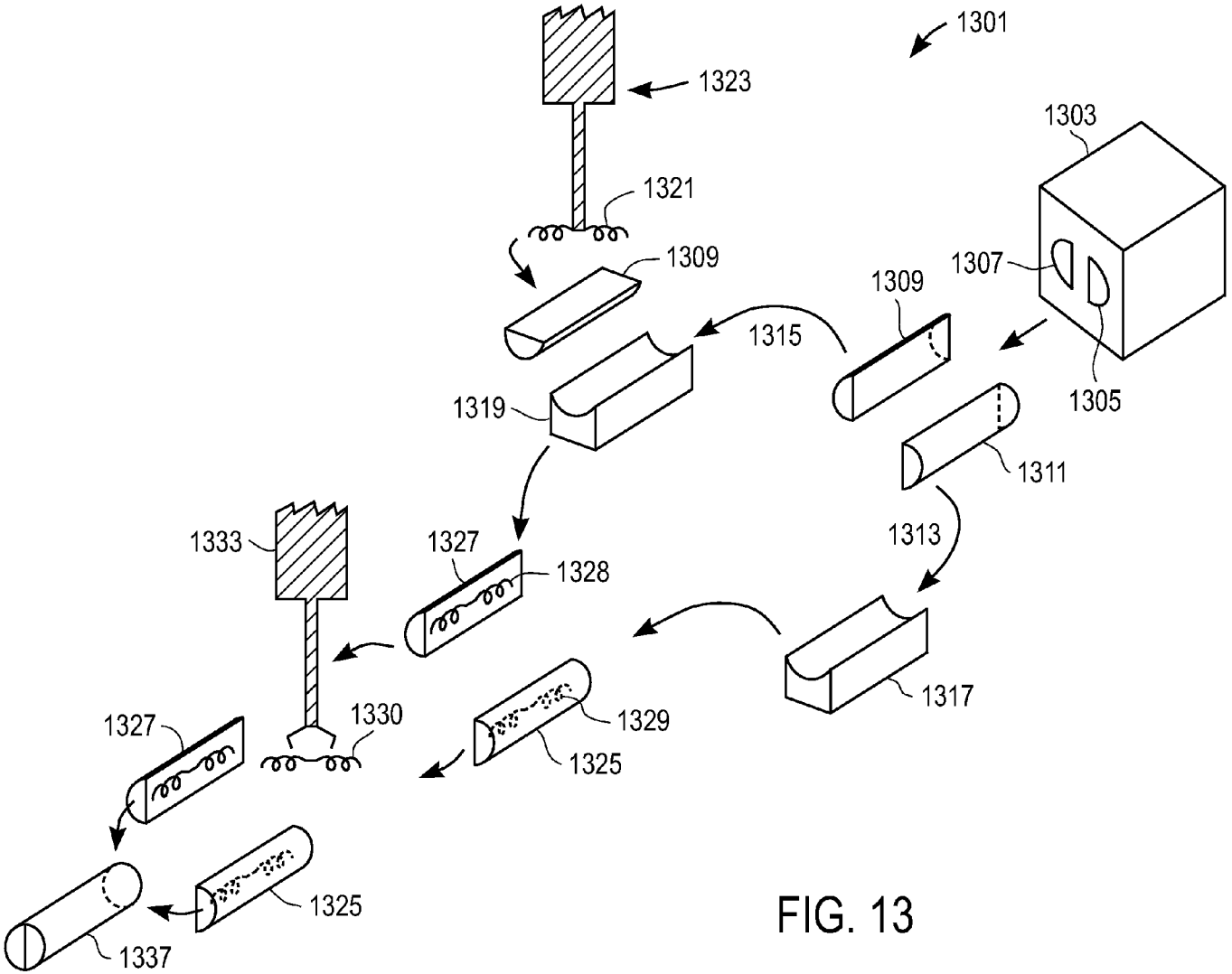
FIG. 13 shows another exemplary method of making a golf ball having a tag.

FIG. 13 shows an exemplary method 1301 for constructing a golf ball, which in the case of this method, has a spiral tag; this method may also be used with the various other tags described herein, such as the multiplanar tags of FIGS. 10A and 10C or the planar tags of FIGS. 3A and 4A. This method may be used to construct one-piece or two-piece or more than two piece golf balls. The extruder 1303 extrudes precursor portions 1309 and 1311 from extrusion openings 1307 and 1305 respectively; the extruder 1303 pushes, in one embodiment, unvulcanized rubber material which is used to form the core of a golf ball (and hence it may be considered a core precursor material). The extruder pushes the material through the openings which have been designed to produce properly sized precursor portions. A knife or blade may be used to create a beginning/front edge and a back edge on the portions. The portions 1309 and 1311 are then respectively transported (e.g. by a conveyor belt) to holders or fixtures 1319 and 1317 as indicated by arrows 1315 and 1313. These holders serve to hold the portions in place while a stamper 1323, having a mold 1321, robotically stamps an imprint of the mold 1321 into the flat face of the portions 1309 and 1311. The mold is designed to have a similar (e.g. substantially the same) shape and size as the tag (e.g. tag 1330) which is to be placed within the slug portions. The slug portions 1309 and 1311 are soft enough, and the mold 1321 hard enough, that a void, having a shape and size which is designed to receive at least a portion of the tag, is created in the face of the portions by the mold. It will be appreciated that the void, on one of the portions, is designed to normally hold about one-half of the tag (and the other half is held in the void in the face of the other portion). After stamping the voids in the faces of the portions 1309 and 1311, two stamped portions 1327 and 1325 are created. These two stamped portions 1327 and 1325 are then combined with a tag 1330 through a robotic arm 1333 which places the tag 1330 into at least one of the voids 1328 and 1329 in the portions 1327 and 1325. In one embodiment of this method, after the tag 1330 is positioned within at least one void, the robotic arm 1333 releases the tag 1330, and this allows the two half portions 1327 and 1325 to be joined together with the tag 1330, in the voids 1328 and 1329, sandwiched between the two portions. This assembly 1337 of tag 1330 and portions 1327 and 1325 may then be processed further by placing the assembly 1337 into a molding chamber to mold the ball or ball core (in a manner which is similar to the operation shown in FIG. 6D). A camera and a motion/position control system may be used to properly position the tag 1330 into at least one of the voids 1328 and 1329. Alternatively, after the stamper 1323 is removed from the slug portion it imprinted, and before the portion is removed from its holder, another robotic arm may place a tag into the just imprinted void while the slug portion is fixed within the holder. As another alternative, the tag may be manually (e.g. by a human) placed within a void of a first slug portion and then the other slug portion is joined manually to the first slug portion to create the assembly 1337. Further, the stamping operation may also be performed manually.

All of the single-plane tags described above may be formed in a manner to create a three-dimensional or multiplanar tag by twisting or bending or otherwise forming such tags so that they have a three-dimensional shape. FIG. 10A shows an example, in a top view, of an "S" shaped tag 1200. This tag may be any of the tags shown in FIGS. 3A through 5P, and it may be formed by twisting or bending the antenna portions, prior to attaching the diode or after attaching the diode. After the tag 1200 is formed, it will be placed within a slug material which has been cut or otherwise formed to have a conforming shape to receive the "S" shaped tag 1200. An example of such slug portions is shown in FIG. 10B which includes slug portions 1202 and 1204 having been cut (or formed) into a shape to receive the "S" shaped tag. Thus, as shown in FIG. 6C, after the tag 1200 is placed within the slug portions 1202 and 1204, the slug assembly may then be placed in a molding chamber, similar to the chamber shown in FIG. 6D, to mold the tag within the slug material to create a golf ball core having the tag. As noted above, the tag may include multiple perforations or at least one perforation, allowing the core material to flow through the perforations in the multiplanar tag to provide a unitary structure such as that shown in FIG. 3E in the case of a multiplanar tag.

Figure 10D:
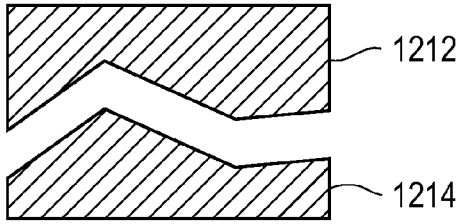
FIG. 10D shows an example of a slug which is cut or formed to receive the tag of FIG. 10C. A view of FIG. 10D is a top view of the two portions of the slug.

FIG. 10C shows another example of a multiplanar tag formed from a single-plane tag such as any one of the tags discussed relative to FIGS. 3A through 5P. In the case of FIG. 10C, the tag may be bent or twisted or otherwise formed into the shape shown in FIG. 10C. FIG. 10C is a top view of the tag 1210. FIG. 10D shows two slug portions 1212 and 1214 which have been cut or otherwise formed to receive the tag 1210. The cut in the slug creates a void into which the tag 1210 is placed. FIG. 10D is a top view of these slug portions and shows how the slug portions can receive the tag 1210. After receiving this tag, the slug portions may be brought together and placed within a molding chamber to mold the slug with the tag 1210 into a golf ball core, similar to the operation shown in FIG. 6D above.

Figure 11A:
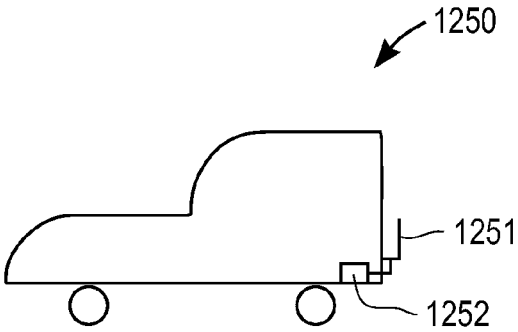
FIG. 11A shows a motorized golf cart having a cradle and a recharging mechanism for a handheld unit.
Figure 11B:
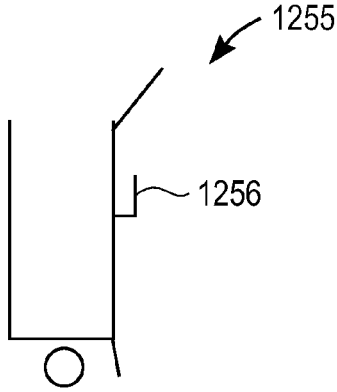
FIG. 11B shows an example of a pull cart having a cradle for a handheld unit of the present invention.

Examples of the use of carts with handheld units of the present invention will now be described relative to FIGS. 11A and 11B. In the case of FIG. 11A, a golf cart 1250 which is motorized (e.g. an electric cart or gasoline powered cart) is shown having a cradle 1251 which is designed to receive and hold a handheld unit, such as the handheld unit 14 of FIG. 1A. A battery recharger system 1252 is coupled to the cradle 1251 to recharge the batteries (which may be rechargeable batteries) in the handheld unit which is placed within the cradle. Thus, when the handheld unit is not being used and is stored or stowed within the cradle 1251, it is charged by a recharging system 1252 which may draw its power from the batteries of the golf cart (or some other existing electrical system of the golf cart). FIG. 11B shows an example of a pull cart which may be used in golf The pull cart 1255 includes a cradle 1256 which is designed to receive a handheld unit, such as the handheld unit 14 of FIG. 1A. The pull cart is shown without a recharging unit, but it will be appreciated that optionally it may include a recharging unit (which includes a battery) to recharge the battery in the handheld unit while it is stored or stowed in the cradle 1256 of the pull cart 1255. Golf bags, such as "shoulder bags," may also include a cradle or holster for holding a handheld unit. These bags, such as Belding bags, are typically slung over the golfer's shoulder and carried in this manner. These bags may optionally include a rechargeable battery to recharge the batteries in the handheld.

Various embodiments of the invention provide for methods of operating golf courses and methods of using findable balls with handhelds. The use of findable balls and handhelds will enable golfers to complete an 18-hole round of golf at a golf course in less time because the time spent looking for lost balls is substantially reduced. A golfer with a handicap in excess of 15 (more than 80% of worldwide golf players) will hit ten or more shots per round that do not land in the fairway. These off-fairway shots are typically not lost but can be found within a search time frame of about 10 seconds to 5 minutes. With a system as described herein, such as a findable ball and a handheld unit, this search time frame is minimized and the pace of play is not adversely impacted. In fact, a typical golfer equipped with a handheld unit and findable balls as described herein should experience an 8-12 minute acceleration in the time it takes him/her to complete an 18-hole round of golf. An 8-minute acceleration represents a 3% throughput improvement for golf course operators who expect an 18-hole round to take about 270 minutes. Golf course operators go to great lengths to communicate and enforce rapid pace of play. Score cards, golf cart signage, on-course signage and roving marshals all have a priority emphasis on speeding up play. Much like a restaurant needs to move tables, the golf course operator needs to get as many players as possible through the course in a given day. Thus, the findable balls and handhelds described herein may be provided by golf course operators to the players so that the golf course operators may achieve this accelerated throughput which will increase the profitability of the golf course operator by increasing revenue to the golf course operator. There are numerous ways in which golf course operators may utilize aspects described herein. For example, a golf course operator may give a discount, such as a discount on the green fee, to a golfer who will use a findable ball and handheld but not give such a discount to a golfer who does not use a findable ball and handheld. The golf course may rent or provide for free findable balls and handheld units to those golfers who do not have their own or may require all golfers to use findable balls and handheld units. A golf course may, after the course closes, cause its employees to search for findable balls containing tags which remain on the course after the course has closed in order to retrieve such balls. By doing so, the course will have fewer such balls and thus there will be fewer false positives (e.g. finding someone else's lost ball from a prior round of golf). The golf course may also employ other methods if findable balls and handheld units are used. For example, the golf course may decide to cut the grass less often in rough areas, allowing this grass to grow higher than is normally done in golf courses which do not use findable balls and handheld units to find the balls. This will tend to decrease expenses for the golf course. The golf course may charge for the use of a golf course (an 18-hole round of golf) based on the amount of time used if the golfer does not use a findable ball and handheld unit, but if the golfer does use a findable ball and a handheld unit, then the charge is a fixed amount or a fixed amount up to a certain amount of time to play the round of golf.

Figure 12:
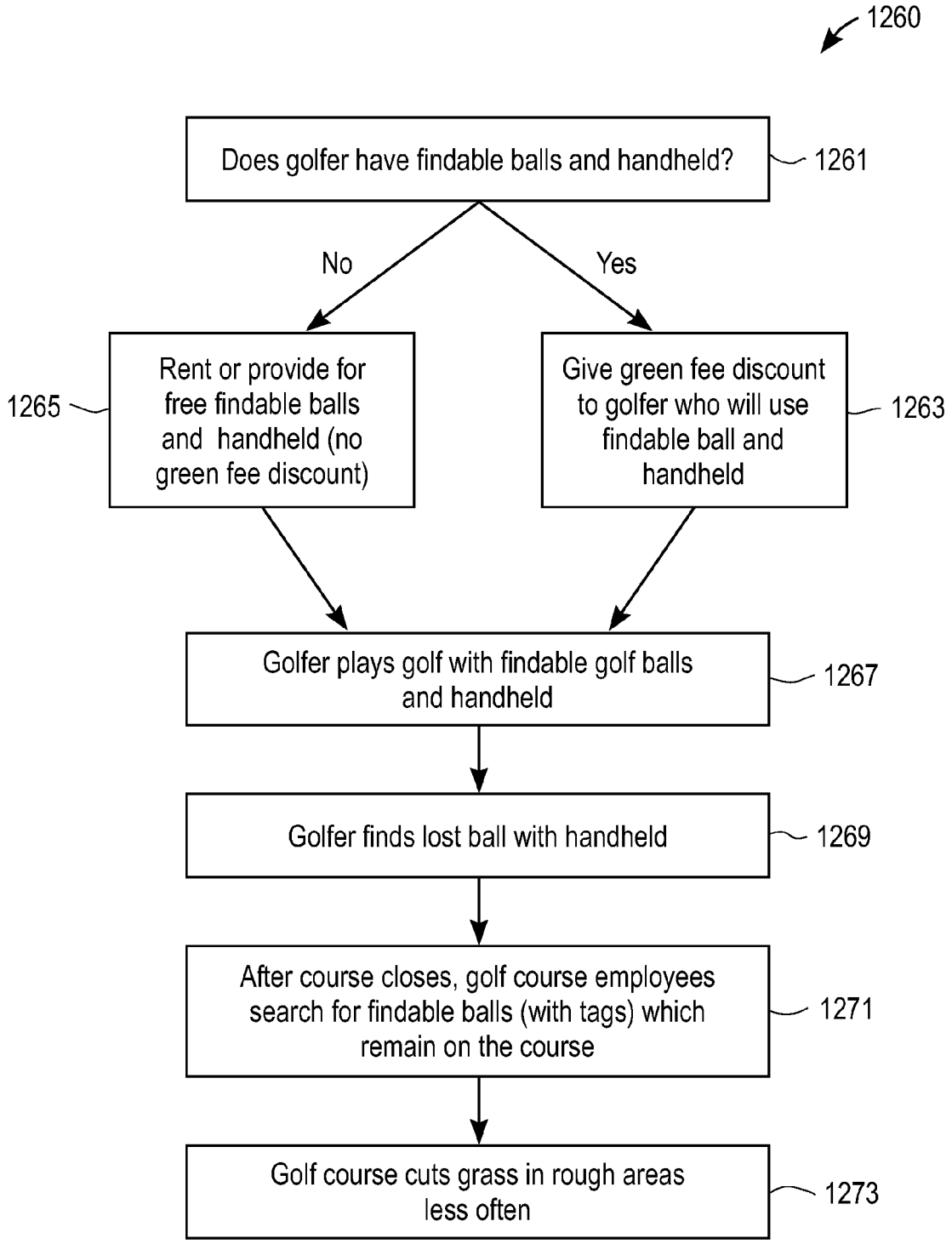
FIG. 12 shows an exemplary embodiment of one method of operating a golf course utilizing findable balls and handheld units of various embodiments of this invention.

FIG. 12 shows a flowchart of one particular method of using findable balls and a handheld. This method may be performed largely by the golf course. The method 1260 shown in FIG. 12 is one example, and it will be appreciated that there are numerous other examples in which different operations are performed in different sequences or are not present or additional operations are present. Upon registering with the golf course, the golf course determines whether a golfer has findable balls and handhelds (operation 1261). If the golfer does have findable balls and handhelds and will use them, then a green fee discount (or some other discount) or some other legal consideration is given to the golfer who will use the findable balls and handheld (operation 1263). If the golfer does not use findable balls and a handheld, then in operation 1265 the golf course may rent or provide for free findable balls and handhelds for use by the golfer, but the golfer will not, in this example, receive a green fee discount. Thus, whether or not the golfer has brought findable balls and a handheld unit for use with the findable balls, all golfers after operations 1263 and 1265 will be using handhelds and findable golf balls (operation 1267). If a ball gets lost, then a golfer may find the lost ball with the handheld in operation 1269. After the golf course has closed for play (or after a round of golf has concluded), golf course employees may search for findable balls (using a handheld unit) which remain on the course. These balls are found and then removed from the course so that fewer false positives will occur for the next rounds of golf which are played. It will be appreciated that this is an optional operation (operation 1271) which may not be performed by some golf courses. The operation 1271 may be performed at some predetermined time (after the course closes) or otherwise (e.g. when it is decided that too many golfers are finding too many false positives). The operation may be performed after each round of golf or every other day after the course closes or once a week (e.g. Sunday night after the course closes) or at some other interval. In operation 1273, the golf course decides to cut the grass in the rough areas less often, thereby allowing it to grow higher. It will also be appreciated that this operation 1273 is also optional. As noted above, these operations may be performed in a different sequence or with more or fewer operations than shown in FIG. 12 which is one example of a method of operating a golf course. It will be appreciated that a typical golf course is not the same as a driving range, but golf courses may include a driving range. It will also be appreciated that the foregoing description applies to clubs which include golf courses.

It will be appreciated that numerous modifications of the various embodiments described herein may be made. For example, each golf ball could be printed with a unique identification number such as a serial number in order to allow a user to identify from a group of lost balls which lost ball is his/her lost ball. Alternatively, a quasi-unique identifier, such as a manufacturing date when the ball is manufactured, may be printed on the outside of the ball so that it can be read by a user to verify that a user's ball has been found within a group of lost balls which have been uncovered by the handheld unit. As noted above, the embodiments of the present invention may be used with one piece or three-piece golf balls in addition to two-piece golf balls described above. In certain embodiments of the present invention, the impedance of the diode may be matched to the impedance of the antenna. It will be appreciated also that the tags discussed above are passive tags having no active components such as semiconductor memory circuits, and the antenna does not need to energize such active components such as semiconductor memory components.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A method of making a golf ball, said method comprising:

forming a core precursor member having a first portion and a second portion;

placing a tag between said first portion and said second portion thereby creating a combined member, said tag having at least one perforation;

placing said combined member into a mold structure;

molding said combined member in the mold structure, said molding causing material from one of said first portion and said second portion to flow into said at least one perforation to contact the other of said first portion and said second portion;

enclosing a core member, obtained through said molding, in a shell, wherein said tag is a substantially planar structure which is substantially symmetrical about an axis which coincides with a diametric axis of said golf ball, and wherein said tag comprises an antenna, said antenna comprising a first wing and a second wing which are symmetrically disposed about said diametric axis, and wherein at least a portion of said at least one perforation separates at least a portion of each of said first wing and said second wing.

2. A method as in claim 1, wherein said forming comprises splitting said core precursor member to create said first portion and said second portion.

3. A method as in claim 1, wherein said tag is completely enclosed within said first portion and said second portion.

4. A method as in claim 1, wherein said forming comprises molding said first portion and said second portion separately.

5. A method as in claim 1, wherein said molding comprises exposing said combined member to a molding temperature and a molding pressure for a predetermined period of time.

6. A method as in claim 5, wherein said molding temperature is in a range from about 200° F. to about 350° F. and said molding pressure is in a range from about 1,000 pounds per square inch (psi) to about 5,000 psi and said predetermined period of time is in a range from about 1 minute to about 15 minutes.

7. A method as in claim 6 further comprising:

cooling said core member prior to said enclosing.

8. A method as in claim 7, wherein said core member is cleaned prior to said enclosing.

9. A method as in claim 6, wherein said molding cures a core material in said first and said second portions.

10. A method as in claim 6 wherein said tag comprises a diode coupled to said antenna, wherein each of said first wing and said second wing has at least a portion of an outer perimeter which substantially conforms to an outer diameter of said core member.

11. A method as in claim 10, wherein said tag further comprises a transmission line which is coupled to said antenna and to said diode.

12. A method as in claim 11, wherein said transmission line has a shaped portion which is substantially bisected by said diametric axis.

* * * * *